US011426777B2

(12) United States Patent
Shafiei et al.

(10) Patent No.: US 11,426,777 B2
(45) Date of Patent: Aug. 30, 2022

(54) SYSTEMS AND METHODS FOR CONTROLLING SURFACE TEXTURING OF A METAL SUBSTRATE WITH LOW PRESSURE ROLLING

(71) Applicant: Novelis Inc., Atlanta, GA (US)

(72) Inventors: Mehdi Shafiei, Farmington Hills, MI (US); Andrew James Hobbis, Bath (CA); David Anthony Gaensbauer, Atlanta, GA (US); Jeffery Edward Geho, Marietta, GA (US); Steven L. Mick, Fairmont, WV (US)

(73) Assignee: Noveliss Inc., Atlanta, GA (US)

( * ) Notice: Subject to any disclaimer, the term of this patent is extended or adjusted under 35 U.S.C. 154(b) by 0 days.

(21) Appl. No.: 16/041,293

(22) Filed: Jul. 20, 2018

(65) Prior Publication Data

US 2019/0022721 A1 Jan. 24, 2019

Related U.S. Application Data

(60) Provisional application No. 62/551,298, filed on Aug. 29, 2017, provisional application No. 62/551,292,
(Continued)

(51) Int. Cl.
*B21B 1/22* (2006.01)
*B21B 37/30* (2006.01)
(Continued)

(52) U.S. Cl.
CPC ..... *B21B 1/227* (2013.01); *B21B 31/20* (2013.01); *B21B 37/28* (2013.01); *B21B 37/30* (2013.01);
(Continued)

(58) Field of Classification Search
CPC ..... B21B 1/227; B21B 37/30; B21B 31/20; B21B 37/28; B21B 2267/10; B21B 29/00;
(Continued)

(56) References Cited

U.S. PATENT DOCUMENTS 1,106,172 A 8/1914 Wetcke
3,619,881 A 11/1971 Bills et al.
(Continued)

FOREIGN PATENT DOCUMENTS

CN 1230475 A 10/1999
CN 201033332 Y 3/2008
(Continued)

OTHER PUBLICATIONS

Suzuki S et al: "Strip Shape Control System of Mitsubishi CR Mill", Conference Record of The 1999 IEEE Industry Applications Conference. 34th IAS Annual Meeting. Phoenix, AZ, Oct. 3-7, 1999; (Year: 1999).*
(Continued)

*Primary Examiner* — Debra M Sullivan
(74) *Attorney, Agent, or Firm* — Kilpatrick Townsend & Stockton LLP

(57) ABSTRACT

Systems and methods of applying a texture on a substrate include applying a texture to the substrate with a work stand of a coil-to-coil process. The work stand includes an upper work roll and a lower work roll vertically aligned with the upper work roll. At least one of the upper work roll and the lower work roll includes the texture. Applying the texture includes applying, by the upper work roll and a lower work roll, a work roll pressure on an upper surface and a lower surface of the substrate. The method further includes adjusting a contact pressure parameter of the work stand such that the work stand provides a desired contact pressure distribution across the width of the substrate and a desired thickness
(Continued)

profile of the edges of the substrate while an overall thickness of the substrate remains substantially constant.

20 Claims, 7 Drawing Sheets

Related U.S. Application Data filed on Aug. 29, 2017, provisional application No. 62/551,296, filed on Aug. 29, 2017, provisional application No. 62/535,349, filed on Jul. 21, 2017, provisional application No. 62/535,345, filed on Jul. 21, 2017, provisional application No. 62/535,341, filed on Jul. 21, 2017.

(51) Int. Cl.

| | |
|---|---|
| ***B21B 37/28*** | (2006.01) |
| ***B21B 31/20*** | (2006.01) |
| *B21B 38/00* | (2006.01) |
| *B21B 37/58* | (2006.01) |
| *B21B 13/14* | (2006.01) |
| *B21B 3/00* | (2006.01) |
| *B21B 29/00* | (2006.01) |
| *B21H 8/00* | (2006.01) |

(52) U.S. Cl.
CPC ..... *B21B 13/14* (2013.01); *B21B 13/147* (2013.01); *B21B 29/00* (2013.01); *B21B 37/58* (2013.01); *B21B 38/00* (2013.01); *B21B 2001/228* (2013.01); *B21B 2003/001* (2013.01); *B21B 2261/14* (2013.01); *B21B 2265/12* (2013.01); *B21B 2267/10* (2013.01); *B21H 8/005* (2013.01)

(58) Field of Classification Search
CPC ..... B21B 13/14; B21B 2001/228; B21B 2003/001; B21B 2261/14; B21B 13/147; B21B 37/58; B21B 38/00; B21B 2265/12; B21B 1/22; B21B 27/005; B21B 37/38; B21B 38/08; B21H 8/005; B44B 5/0009
See application file for complete search history.

(56) References Cited

U.S. PATENT DOCUMENTS

| | | | | |
|---|---|---|---|---|
| 4,017,367 | A | 4/1977 | Saunders | |
| 4,978,583 | A | 12/1990 | Wakui et al. | |
| 5,025,547 | A | 6/1991 | Sheu et al. | |
| 5,508,119 | A | 4/1996 | Sheu et al. | |
| 5,666,844 | A | 9/1997 | Bieber | |
| 5,904,204 | A * | 5/1999 | Teraoka | B22D 11/0622 164/417 |
| 6,868,707 | B2 | 3/2005 | Nishi et al. | |
| 7,353,681 | B2 | 4/2008 | Ball et al. | |
| 7,516,637 | B2 | 4/2009 | Scamans et al. | |
| 7,624,609 | B2 | 12/2009 | Ball et al. | |
| 11,213,870 | B2 | 1/2022 | Shafiei et al. | |
| 2003/0150587 | A1* | 8/2003 | Li | B22D 11/003 164/452 |
| 2005/0115295 | A1 | 6/2005 | Pont | |
| 2006/0123867 | A1* | 6/2006 | Ball | B44B 5/00 72/197 |
| 2009/0004044 | A1* | 1/2009 | Sawada | B22D 11/0622 420/528 |
| 2010/0242559 | A1 | 9/2010 | Saenz de Miera | |
| 2010/0249973 | A1 | 9/2010 | Bergsten | |
| 2012/0298183 | A1 | 11/2012 | Buresch et al. | |
| 2013/0273394 | A1 | 10/2013 | Sheu et al. | |
| 2016/0052032 | A1 | 2/2016 | Moden | |
| 2016/0059283 | A1 | 3/2016 | Breuer et al. | |
| 2019/0022720 | A1 | 1/2019 | Shafiei et al. | |
| 2019/0022724 | A1 | 1/2019 | Shafiei et al. | |

FOREIGN PATENT DOCUMENTS

| | | | | |
|---|---|---|---|---|
| CN | 101288880 | A | 10/2008 | |
| CN | 202984272 | U | 6/2013 | |
| CN | 103949481 | A | 7/2014 | |
| CN | 104785541 | A | 7/2015 | |
| CN | 104870111 | A | 8/2015 | |
| CN | 106903170 | A | 6/2017 | |
| DE | 102007028823 | | 12/2008 | |
| EP | 1368140 | A1 * | 12/2003 | B21B 1/227 |
| EP | 1607150 | | 12/2005 | |
| EP | 1607150 | A1 * | 12/2005 | B21B 37/30 |
| EP | 1297903 | | 8/2006 | |
| EP | 1368140 | | 8/2006 | |
| EP | 2292341 | | 3/2011 | |
| EP | 2670540 | | 2/2016 | |
| GB | 191410850 | A | 7/1914 | |
| JP | S6286120 | A | 4/1987 | |
| JP | H03114601 | A | 5/1991 | |
| JP | H03169403 | A | 7/1991 | |
| JP | H03238108 | A | 10/1991 | |
| JP | H06171261 | A | 6/1994 | |
| JP | H0751701 | A | 2/1995 | |
| JP | H09225555 | A | 9/1997 | |
| JP | H10501470 | A | 2/1998 | |
| JP | 2006239744 | A | 9/2006 | |
| JP | 2007516841 | A | 6/2007 | |
| JP | 2010260074 | A | 11/2010 | |
| JP | 2012052290 | A | 3/2012 | |
| JP | 2012157899 | A | 8/2012 | |
| JP | 2012206170 | A | 10/2012 | |
| JP | 2013094820 | A | 5/2013 | |
| JP | 2015182107 | A | 10/2015 | |
| JP | 6171261 | | 7/2017 | |
| RU | 2158639 | C2 | 11/2000 | |
| RU | 2333811 | C2 | 9/2008 | |
| SU | 100256 | A | 11/1954 | |
| SU | 931244 | A1 | 5/1982 | |
| SU | 1447447 | A1 | 12/1988 | |
| WO | 2006002784 | | 1/2006 | |
| WO | 2016034658 | A1 | 3/2016 | |

OTHER PUBLICATIONS

PCT/US2018/043047 , "International Search Report and Written Opinion", dated Oct. 15, 2018, 14 pages.
Suzuki et al., "Strip Shape Control System of Mitsubishi CR Mill", Conference Record Of The IEEE Industry Applications Conference. 34th IAS Annual Meeting. Phoenix, AZ, Oct. 3, 1999, pp. 565-570.
Australian Patent Application No. 2018302334 , First Examination Report dated Oct. 20, 2020, 5 pages.
Indian Patent Application No. 202017001917 , First Examination Report dated Dec. 1, 2020, 5 pages.
Australian Patent Application No. 2018302334 , Second Examination Report dated Mar. 15, 2021, 4 pages.
Canadian Patent Application No. 3,069,978 , Office Action dated Apr. 12, 2021, 11 pages.
Chinese Patent Application No. 201880048769.7 , Office Action dated Jan. 4, 2021, 27 pages.
Japanese Patent Application No. 2020-502650 , Office Action dated Feb. 2, 2021, 14 pages.
Korean Patent Application No. 10-2020-7004645 , Office Action dated Mar. 18, 2021, 18 pages.
Chinese Application No. 201880048769.7, Office Action, dated Jun. 24, 2021, 28 pages.
Japanese Application No. 2020-502650, Notice of Decision to Grant, dated Aug. 10, 2021, 3 pages.
Korean Application No. 10-2020-7004645, Office Action, dated Aug. 17, 2021, 3 pages.
Japanese Patent Application No. 2020-502650 , Office Action dated May 18, 2021, 8 pages.

(56) References Cited

OTHER PUBLICATIONS

AU2018302334 , "Notice of Acceptance", dated Oct. 25, 2021, 3 pages.
Russian Patent Application No. 2020102512 , Office Action, dated Jul. 6, 2020, 19 pages.
U.S. Appl. No. 16/041,288 , Final Office Action, dated Jan. 13, 2022, 20 pages.
Application No. CA3,069,978 , Office Action, dated Jan. 11, 2022, 5 pages.
Application No. CN201880048599.2 , Office Action, dated Jan. 12, 2022, 15 pages.

* cited by examiner

SYSTEMS AND METHODS FOR CONTROLLING SURFACE TEXTURING OF A METAL SUBSTRATE WITH LOW PRESSURE ROLLING

REFERENCE TO RELATED APPLICATIONS

This application claims the benefit of U.S. Provisional Application No. 62/535,345, filed on Jul. 21, 2017 and entitled SYSTEMS AND METHODS FOR CONTROLLING SURFACE TEXTURING OF A METAL SUBSTRATE WITH LOW PRESSURE ROLLING; U.S. Provisional Application No. 62/535,341, filed on Jul. 21, 2017 and entitled MICRO-TEXTURED SURFACES VIA LOW PRESSURE ROLLING; U.S. Provisional Application No. 62/535,349, filed on Jul. 21, 2017 and entitled SYSTEMS AND METHODS FOR CONTROLLING FLATNESS OF A METAL SUBSTRATE WITH LOW PRESSURE ROLLING; U.S. Provisional Application No. 62/551,296, filed on Aug. 29, 2017 and entitled SYSTEMS AND METHODS FOR CONTROLLING SURFACE TEXTURING OF A METAL SUBSTRATE WITH LOW PRESSURE ROLLING; U.S. Provisional Application No. 62/551,292, filed on Aug. 29, 2017 and entitled MICRO-TEXTURED SURFACES VIA LOW PRESSURE ROLLING; and U.S. Provisional Application No. 62/551,298, filed on Aug. 29, 2017 and entitled SYSTEMS AND METHODS FOR CONTROLLING FLATNESS OF A METAL SUBSTRATE WITH LOW PRESSURE ROLLING, all of which are hereby incorporated by reference in their entireties.

FIELD OF THE INVENTION

This application relates to control systems and methods for controlling surface texturing of a metal substrate with low pressure rolling in a coil-to-coil process.

BACKGROUND

During a coil-to-coil process, metal strip, stock, plate or substrate (herein "metal substrate") is passed through a pair of rolls. In some cases, it may be desirable to apply a texture or pattern to a surface of the metal substrate during coil-to-coil processing. However, the force applied by the rolls to the metal substrate during the texturing process can distort the characteristics of the metal substrate and/or of the pattern on the metal substrate.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

Certain aspects and features of the present disclosure relate to a method of applying a texture on a substrate. In some examples, the substrate may be a metal substrate (e.g., a metal sheet or a metal alloy sheet) or a non-metal substrate. For example, the substrate may include aluminum, aluminum alloys, steel, steel-based materials, magnesium, magnesium-based materials, copper, copper-based materials, composites, sheets used in composites, or any other suitable metal, non-metal, or combination of materials.

In some aspects, the substrate is a metal substrate. Although the following description is provided with reference to the metal substrate, it will be appreciated that the description is applicable to various other types of metal or non-metal substrates. According to various examples, a method of applying a texture on a metal substrate includes applying a texture to the metal substrate with a work stand of a coil-to-coil processing system. The work stand includes an upper work roll and a lower work roll vertically aligned with the upper work roll. The upper work roll and lower work roll are supported by intermediate rolls. Bearings are provided along the intermediate rolls and are configured to impart bearing loads on the intermediate rolls. At least one of the upper work roll and the lower work roll includes the texture. Applying the texture includes applying, by the upper work roll, a first work roll pressure on an upper surface of the metal substrate and applying, by the lower work roll, a second work roll pressure on a lower surface of the metal substrate. The method also includes measuring a contact pressure distribution of at least one of the first work roll pressure and the second work roll pressure across a width of the metal substrate with a sensor and receiving data at a processing device from the sensor. The method further includes adjusting a pressure parameter of the work stand such that the work stand provides a desired contact pressure distribution across the width of the metal substrate and a thickness of the metal substrate remains substantially constant after the texture has been applied.

The yield strength of a substrate refers to an amount of stress or pressure at which plastic deformation occurs through a portion of the thickness or gauge of the substrate (e.g., an amount of stress or pressure that can cause a permanent change in a portion of the thickness or gauge of the metal substrate). During a texturing process, to prevent the thickness of the metal substrate from being reduced (e.g., the thickness of the metal substrate remains substantially constant and there is substantially no reduction in the thickness of the metal substrate), the bearings are configured to impart bearing loads on the intermediate rolls. The intermediate rolls then transfer the load to the work rolls such that the work rolls impart a work roll pressure on the metal substrate that is below the yield strength of the metal substrate as the metal substrate passes between the work rolls. A contact pressure distribution refers to the distribution of the work roll pressure over the surface and across the width of the substrate as it passes between the work rolls. Because the work roll pressure imparted by the work rolls on the metal substrate generates a pressure that is below the yield strength of the metal substrate, the thickness of the metal substrate remains substantially constant (e.g., there is substantially no reduction in the thickness of the metal substrate).

While the work roll pressure applied by the work rolls is below the yield strength of the metal substrate, the texture on the work rolls may have a topography that creates localized areas on the surface of the metal substrate where the localized pressure is above the yield strength of the metal substrate as the metal substrate passes between the work rolls. These localized areas may form various asperities or skews, which are projections or indentations on the surface of the metal substrate of any suitable height, depth, shape, or size depending on a desired application or use of the metal substrate. In other words, the work rolls can generate localized pressure at asperity contacts that may be high enough to overcome the yield strength of the metal substrate in these localized areas. At these localized areas, because the pressure created by the texture is greater than the yield strength of the metal substrate, the texture creates localized areas of partial plastic deformation on the surface of the metal substrate and impresses various textures, features, or patterns onto the surface of the metal substrate while leaving the remainder of the metal substrate un-deformed (e.g., the texture causes plastic deformation at a particular location on the surface of the metal substrate while the thickness of the metal substrate remains substantially constant along the metal substrate). In some examples, the localized pressure created by the texture at the localized areas is greater than the yield strength such that the various textures, features, or patterns can be impressed on the surface, but the overall work roll pressure is not sufficient to cause a substantial reduction in a thickness of the metal substrate at the localized areas. As an example, the localized pressure created by the texture at the localized areas is greater than the yield strength of the metal substrate such that the various textures, features, or patterns can be impressed on the surface, but does not cause a substantial reduction in a thickness of the metal substrate across a width or along a length of the metal substrate. As an example, the pressure can cause less than a 1% reduction in the thickness of the metal substrate across the width or along a length of the metal substrate. Thus, in some examples, work rolls can be used to cause localized areas of plastic deformation on the surface of the metal substrate (i.e. to transfer the texture from the work rolls to the surface of the metal substrate) without changing the overall thickness of the metal substrate.

In some examples, impressing different textures, patterns, or features on the surface of the metal substrate can cause the metal substrate to have enhanced characteristics, including, for example, increased lubricant retention, increased de-stacking capabilities, increased resistance spot weldability, increased adhesion, reduced galling, enhanced optical properties, frictional uniformity, etc.

These advantages, among others, may allow the metal substrate, often in the form of metal sheet or plate, to be further processed into automotive parts, beverage cans and bottles, and/or any other highly-formed metal product with greater ease and efficiency. For example, the improved tribological characteristics of the metal substrate having a surface with various textures described herein may allow for faster and more stable processing of high-volume automotive products because the friction characteristics of the textured metal substrate being formed are more consistent and isotropic between different batches of material and/or along the same strip of metal substrate. In addition, introducing negatively skewed surface textures (e.g., micro-dimples on the surface of the metal substrate) could help disrupt the surface tension between lubed metal substrates that are stacked together, thus improving de-stacking capability. Furthermore, the improved ability for the surface of the metal substrate to retain lubricant may further reduce and/or stabilize frictional forces between the forming die and the sheet metal surfaces, leading to better formability with reduced earing, wrinkling and tear-off rates; higher processing speeds; reduced galling, enhanced tool life and improved surface quality in the formed parts.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of examples of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 2:
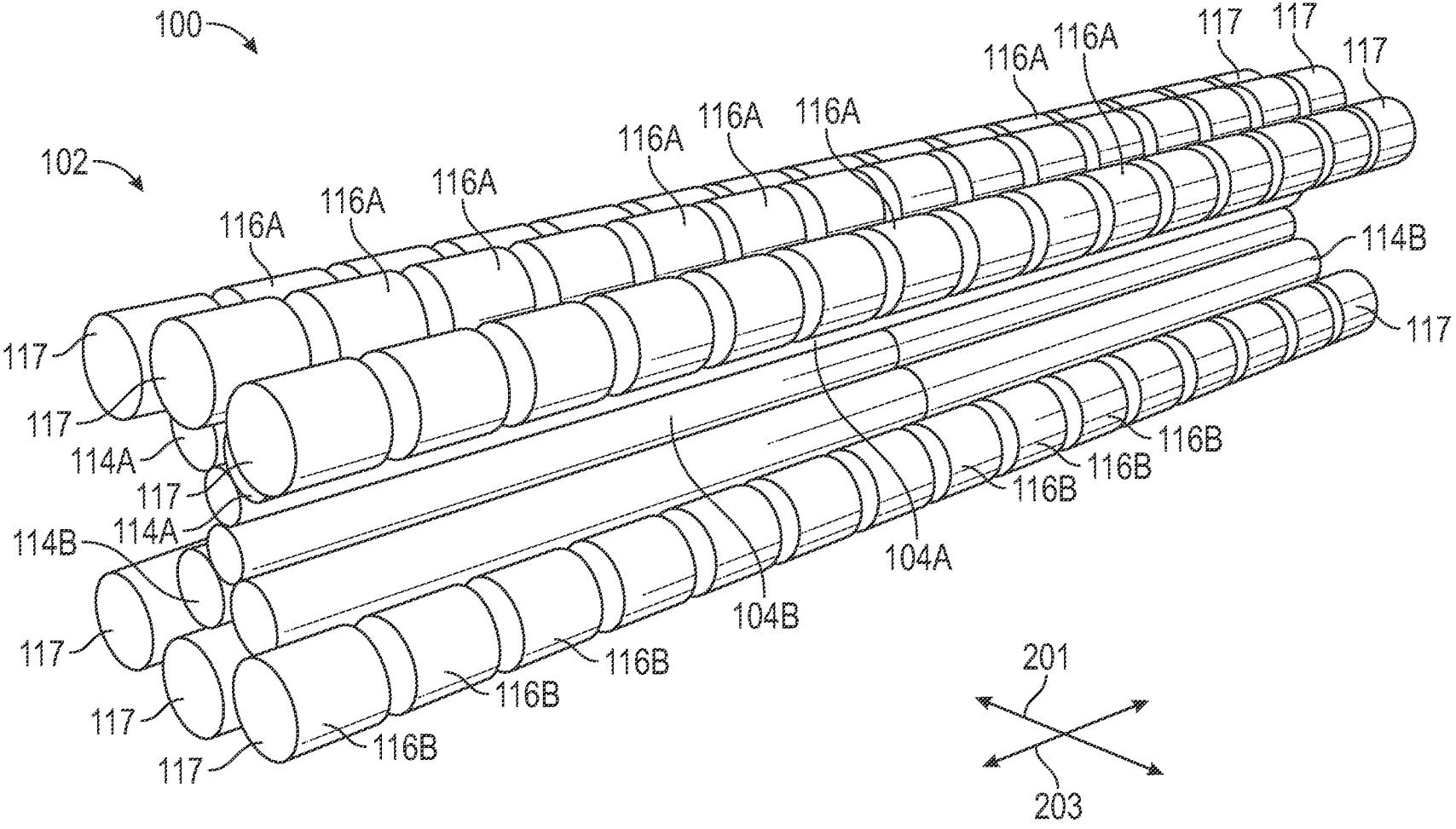
FIG. 2 is another schematic of the stand of FIG. 1.

As used herein, a length of a component of the system generally refers to a dimension of that component that extends in the direction 201 illustrated in FIG. 2. A width of a component of the system generally refers to a dimension of that component that extends in the direction 203, which is transverse to the direction 201.

Certain aspects and features of the present disclosure relate to a method of applying a texture on a substrate. In some examples, the substrate may be a metal substrate (e.g., a metal sheet or a metal allow sheet) or a non-metal substrate. For example, the substrate may include aluminum, aluminum alloys, steel, steel-based materials, magnesium, magnesium-based materials, copper, copper-based materials, composites, sheets used in composites, or any other suitable metal, non-metal, or combination of materials. In some aspects, the substrate is a metal substrate. Although the following description is provided with reference to the metal substrate, it will be appreciated that the description is applicable to various other types of metal or non-metal substrates.

Certain aspects and features of the present disclosure relate to control systems and methods for controlling one or more pressure parameters (e.g., parameters that affect the work roll pressure of the work rolls against the metal substrate) to provide a desired contact pressure distribution over the surface and across the width of a metal substrate. In some cases, the desired contact pressure distribution both minimizes pressure variation and reduces edge effects of the metal substrate from processing such that a thickness of the metal substrate remains substantially constant during cold rolling with a coil-to-coil process. By controlling the contact pressure distribution, a uniformity of the texture (e.g. consistency of texture size, depth, height, shape, coarseness, distribution, concentration, etc.) can also be controlled/improved. In various cases, the use of the control system to adjust or adapt pressure parameters produces a metal substrate with improved texture consistency.

A coil-to-coil process includes at least one stand, and in some examples, the coil-to-coil process may include multiple stands. Cold rolling refers to rolling the metal at any temperatures low enough for strain-hardening to occur, even if the substrate would feel hot to human senses. As one non-limiting example, in some cases, the starting temperature of a substrate in a coil-to-coil process may be from about 50° C. to about 100° C., and the temperature of the substrate leaving the coil-to-coil process may be up to about 200° C. Various other temperatures low enough for strain-hardening to occur may be utilized.

Each stand includes a pair of work rolls that are vertically aligned. The work rolls are supported by intermediate rolls, and bearings are provided along the intermediate rolls to impart bearing loads on the intermediate rolls. A roll gap is defined between the work rolls, and during processing, the metal substrate is passed through the roll gap. As the metal substrate is passed through the roll gap, the work rolls apply a work roll pressure on the metal substrate. In some examples, at least one of the work rolls includes a texture such that as the work rolls apply the work roll pressure on the metal substrate, the texture is transferred onto a surface of the metal substrate.

During a texturing process, to prevent the thickness of the metal substrate from being reduced (e.g., the thickness of the metal substrate remains substantially constant and there is substantially no reduction in the thickness of the metal substrate), the bearings are configured to impart bearing loads on the intermediate rolls that are below a yield strength of the substrate. The intermediate rolls transfer the load to the work rolls such that the work rolls impart a work roll pressure on the metal substrate that is below the yield strength of the metal substrate as the metal substrate passes between the work rolls. Because the work roll pressure imparted by the work rolls on the metal substrate is below the yield strength of the metal substrate, the thickness of the metal substrate remains substantially constant (e.g., there is substantially no reduction in the thickness of the metal substrate).

While the work roll pressure applied by the work rolls is below the yield strength of the metal substrate, the texture on the work rolls may have a topography that creates localized areas on the surface of the metal substrate where the localized pressure applied by the work rolls is above the yield strength of the metal substrate as the metal substrate passes between the work rolls. In other words, the surface profile of the texture in combination with the work roll pressure that is less than the yield strength of the metal substrate may create areas where the pressure on the surface of the metal substrate is greater than the yield strength of the metal substrate. At these localized areas, because the pressure created by the texture is greater than the yield strength of the metal substrate, the texture creates localized areas of partial plastic deformation on the surface of the substrate that leaves the remainder of the metal substrate un-deformed (e.g., the texture causes plastic deformation at a particular location on the surface of the metal substrate while allowing the thickness of the metal substrate to remain substantially constant along the remainder of the metal substrate). Thus, in some examples, work rolls can be used to cause localized areas of plastic deformation on the surface of the metal substrate (i.e., to transfer the texture from the work rolls to the surface of the metal substrate) without changing the thickness of the metal substrate.

Figure 1:
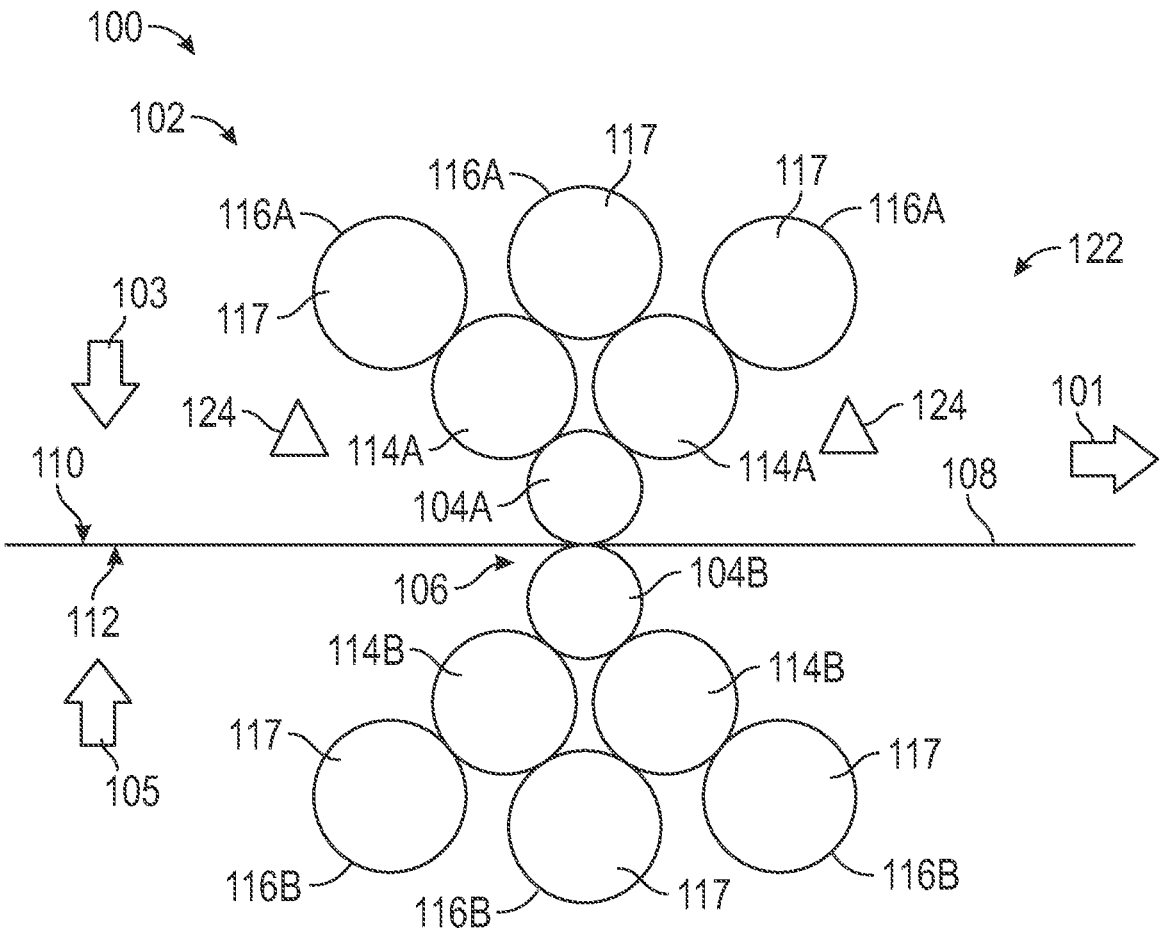
FIG. 1 is a schematic of a stand of a coil-to-coil processing system according to aspects of the present disclosure.
Figure 3:
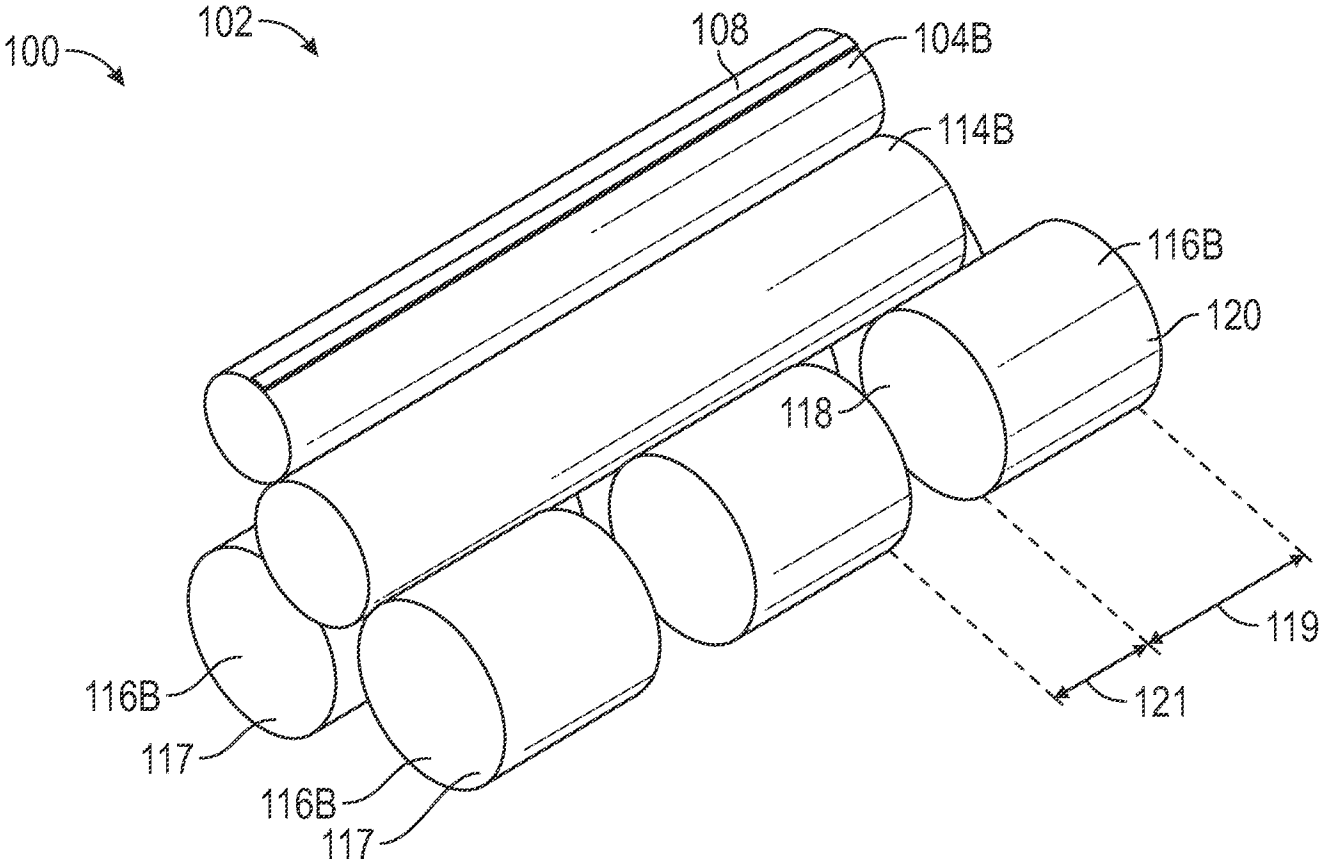
FIG. 3 is an enlarged view of the stand of FIG. 2.

Referring to FIGS. 1-3, a coil-to-coil process 100 includes at least one stand 102. The stand 102 includes an upper work roll 104A and a lower work roll 104B vertically aligned with the upper work roll 104A. A gap 106 is defined between the upper work roll 104A and the lower work roll 104B that is configured to receive a metal substrate 108 during texturing of the metal substrate 108, as described in detail below. In other examples, a substrate may be various other metal or non-metal substrates. During processing, the upper work roll 104A and the lower work roll 104B are configured to contact and apply a work roll pressure to the upper surface 110 and the lower surface 112 of the metal substrate 108 as the metal substrate 108 passes through the gap 106.

Across a width of the metal substrate 108, which is transverse to a direction of movement 101 of the metal substrate 108, the metal substrate 108 generally has edge portions (i.e. the portions near the outermost edges of the metal substrate 108 that extend in the direction of movement 101) and non-edge portions (i.e. the portions between the edge portions). In some examples, a thickness profile of the edge portions may be different relative to the non-edge portions due to processing of the metal substrate 108 prior to texturing. In general, texture uniformity of the non-edge portions is increased by providing a contact pressure distribution that minimizes variations in work roll pressure across the width of the metal substrate 108. However, because of the potentially different thickness profiles of the edge portions and the non-edge portions, the work roll pressure needed at the edge portions may be different from the work roll pressure needed at the non-edge portions to provide a uniform texture across the width of the metal substrate 108. Therefore, a contact pressure distribution that improves texture uniformity must take into account the work roll pressure needs at both the edge portions and non-edge portions of the metal substrate 108.

The work rolls 104A-B are generally cylindrical with a certain roundness or cylindricity, and are constructed from various materials such as steel, brass, and various other suitable materials. The roundness or cylindricity of each of the work rolls 104A-B may be determined using various dial gauges and/or other indicators positioned at multiple points along the width of the work roll 104A-B. Each work roll 104A-B has a work roll diameter. The work roll diameter may be from about 20 mm to about 200 mm. A distance from a first end to a second end of each work roll 104A-B is referred to as a work roll width, which is generally a direction transverse to the direction of movement 101 of the metal substrate 108 during processing. The work rolls 104A-B can be driven by a motor or other suitable device for driving the work rolls 104A-B and causing the work rolls 104A-B to rotate. The work rolls 104A-B apply pressure on the metal substrate 108 during processing along the work roll width. The overall pressure generated by the work rolls is referred to as a work roll pressure. The work roll pressure applied by the work rolls 104A-B is below the yield strength of the metal substrate 108 as described above. For example, the work roll pressure may be from about 1 MPa to about the yield strength of the metal substrate 108.

Localized areas along the work roll generate localized pressures, which may be the same or different from other localized areas along the work roll. Therefore, the pressure may be varied along the work roll width. A contact pressure distribution refers to a distribution of pressure applied by each work roll 104A-B over the surface of the substrate and along the width of the work rolls 104A-B as the metal substrate 108 passes between the work rolls 104A-B. Contact pressure distribution for each work roll 104A-B may be calculated based on a distribution of local bending along the width of the respective work roll 104A-B as a result of the load profile applied to bearings 116A-B of the work stand 102. The calculation of contact pressure distribution further takes into account the rigidity of the materials and the metal or material forming the substrate 108.

As described in detail below, various pressure parameters may be controlled during processing of the metal substrate 108 to achieve a desired contact pressure distribution across the width of the metal substrate 108 (including both edge portions and non-edge portions) while a thickness of the metal substrate 108 remains substantially constant.

In various examples, one or both of the work rolls 104A-B includes one or more textures along an outer surface of the roll. During texturing, the one or more textures are at least partially transferred onto one or both of the surfaces 110 and 112 of the metal substrate 108 as the metal substrate 108 passes through the gap 106. In various examples, the work roll 104A may be textured through various texturing techniques including, but not limited to, electro-discharge texturing (EDT), electrodeposition texturing, electrofusion coating, electron beam texturing (EBT), laser beam texturing, and various other suitable techniques. The one or more textures on the metal substrate 108 may have various characteristics. For example, the one or more textures can have a size, shape, depth, height, coarseness, distribution, and/or concentration. A uniformity of texture refers to at least one of the characteristics of the texture transferred to the metal substrate 108 by the work rolls 104A-B being within predetermined tolerances for consistency in the length and width of the metal substrate, and generally correlates with a contact pressure distribution.

During texturing, the metal substrate 108 passes through the gap 106 as the work rolls 104A-B rotate. The work rolls 104A-B apply the work roll pressure on the metal substrate 108 such that the texture is transferred from at least one of the work rolls 104A-B to at least one of the surfaces 110 and 112 of the metal substrate 108. In various examples, the amount of work roll pressure applied by the work rolls 104A-B across the width of the metal substrate 108 may be controlled by optimizing various pressure parameters to provide a desired contact pressure distribution, as described in detail below. By controlling the contact pressure distribution, the uniformity of the texture (e.g., consistency of size, depth, height, shape, coarseness, distribution, concentration, etc.) of the metal substrate 108 can also be controlled.

In various examples, the work roll pressure applied by the work rolls 104A-B to the metal substrate 108 allows the thickness of the metal substrate 108 to remain substantially constant (e.g., there is substantially no reduction in the overall thickness of the metal substrate 108). As an example, the work roll pressure applied by the work rolls 104A-B may cause the thickness of the metal substrate 108 to decrease between about 0% and about 1%. For example, the thickness of the metal substrate 108 may decrease by less than about 0.5% as the metal substrate 108 passes through the gap 106.

More specifically, the work rolls 104A-B apply a work roll pressure that is below a yield strength of the metal substrate 108, which can prevent the thickness of the metal substrate 108 from being substantially reduced (e.g., reduced by more than 1%) as the metal substrate 108 passes through the gap 106. The yield strength of a substrate refers to an amount of strength or pressure at which plastic deformation occurs through substantially the entire thickness or gauge of the substrate 108 (e.g., an amount of strength or pressure that can cause a substantially permanent change in substantially the entire thickness or gauge of the substrate 108). During texturing, to prevent the thickness of the metal substrate from being reduced, a load is imparted to the work rolls 104A-B such that the work rolls 104A-B impart a work roll pressure on the metal substrate 108 that is below the yield strength of the metal substrate 108 as the metal substrate 108 passes through the gap 106. Because the work roll pressure imparted by the work rolls 104A-B on the metal substrate 108 is below the yield strength of the metal substrate 108, the thickness of the metal substrate 108 remains substantially constant (e.g., the thickness of the metal substrate 108 remains substantially constant and there is substantially no reduction in the thickness of the metal substrate 108).

While the work roll pressure applied by the work rolls 104A-B is below the yield strength of the metal substrate 108, the texture on the work rolls 104A-B may have a topography that creates localized areas on the surface of the metal substrate 108 where the pressure applied by the work rolls 104A-B is above the yield strength of the metal substrate 108 as the metal substrate 108 passes between the work rolls 104A-B. In other words, the work roll can generate localized pressures at the asperity contacts that may be high enough to overcome the yield strength of the metal substrate 108 in these localized areas. At these localized areas, because the localized pressure created by the texture is greater than the yield strength of the metal substrate 108, the texture creates localized areas of partial plastic deformation on the surface of the metal substrate 108 that leaves the metal substrate 108 un-deformed (e.g., the texture causes plastic deformation at a particular location on the surface 110 and/or 112 of the metal substrate 108 while the thickness of the metal substrate 108 remains substantially constant along the metal substrate 108). Thus, in some examples, the work rolls 104A-B can be used to cause localized areas of plastic deformation on the surface 110 and/or 112 of the metal substrate 108 without changing the thickness of the metal substrate 108 (e.g., without reducing the thickness of the entire metal substrate 108). In various examples, a variation in thickness across the width of the metal substrate as a result of the texturing process is less than approximately 1% after the texture has been applied. In various examples, a variation in thickness across the width of the metal substrate as a result of both the texturing process and rolling during coil-to-coil processing is less than approximately 2%.

In some examples, the work roll pressure applied by the work rolls 104A-B is such that a length of the metal substrate 108 remains substantially constant (e.g., there is substantially no elongation or increase in the length of the metal substrate 108) as the metal substrate 108 passes through the gap 106. As an example, the work roll pressure applied by the work rolls 104A-B may cause the length of the metal substrate 108 to increase between about 0% and about 1%. For example, the length of the metal substrate 108 may increase by less than about 0.5% as the metal substrate 108 passes through the gap 106.

As illustrated in FIGS. 1-3, the upper work roll 104A is supported by upper intermediate rolls 114A, and the lower work roll 104B is supported by lower intermediate rolls 114B. Although two upper intermediate rolls 114A and two lower intermediate rolls 114B are illustrated, the number of upper intermediate rolls 114A and lower intermediate rolls 114B supporting each work roll 104A-B may be varied. In various examples, the intermediate rolls 114A-B are provided to help prevent the work rolls 104A-B from separating as the metal substrate 108 passes through the gap 106. The intermediate rolls 114A-B are further provided to transfer bearing loads from bearings 116A-B to the work rolls 104A-B, respectively, such that the work rolls 104A-B apply the work roll pressure to the metal substrate 108.

Similar to the work rolls 104, the intermediate rolls 114A-B are generally cylindrical with a certain roundness or cylindricity. The roundness or cylindricity of each of the intermediate rolls 114A-B may be determined using various dial gauges and/or other indicators positioned at multiple points along the width of the intermediate rolls 114A-B. The intermediate rolls 114A-B may be constructed from various materials such as steel, brass, and various other suitable materials. Each intermediate roll 114A-B defines an intermediate roll diameter. The intermediate roll diameter may be from about 20 mm to about 300 mm. In some examples, the intermediate roll diameter is greater than the work roll diameter, although it need not be.

As illustrated in FIGS. 1-3, the stand 102 also includes the plurality of bearings 116A-B. Upper bearings 116A are provided along the upper intermediate rolls 114A and are configured to apply bearing loads on the upper intermediate rolls 114A, which then transfer the load to the upper work roll 104A such that the upper work roll 104A applies the work roll pressure to the surface 110 of the metal substrate 108. Similarly, lower bearings 116B are provided along the lower intermediate rolls 114B and are configured to apply bearing loads on the lower intermediate rolls 114B, which then transfer the load to the lower work roll 104B such that the lower work roll 104B applies the work roll pressure to the surface 112 of the metal substrate 108. For example, in various cases, the bearings 116A-B apply vertical bearing loads when the metal substrate 108 moves horizontally in the direction of movement 101. In some examples, the bearing load is from about 2 kgf to about 20,000 kgf. In some examples, at least some of the bearings 116A-B are independently adjustable relative to the respective work roll 104A-B such that the localized pressure at discrete locations along the width of the work roll 104A-B can be independently controlled. In other examples, two or more bearings 116A-B may be adjusted in unison.

In some cases, during texturing, the upper work roll 104A may be actuated in the direction generally indicated by arrow 103 and the lower work roll 104B may be actuated in the direction generally indicated by arrow 105. In such examples, the work rolls are actuated against both the upper surface 110 and the lower surface 112 of the metal substrate 108. However, in other examples, only one side of the stand 102/only one of the work rolls 104A-B may be actuated, and actuation indicated by the arrow 103 or actuation indicated by the arrow 105 may be omitted. In such examples, during texturing, the bearings on one side may be frozen and/or may be omitted altogether such that one of the work rolls 104A-B is not actuated (i.e., actuation on the metal substrate is only from one side of the metal substrate). For example, in some cases, the lower bearings 116B may be frozen such that the lower work roll 104B is frozen (and is not actuated in the direction indicated by arrow 105). In other examples, the lower bearings 116B may be omitted such that the lower work roll 104B is frozen.

Each bearing 116A-B is generally cylindrical and may be constructed from tool steel and/or various other suitable materials. Each bearing 116A-B also has a bearing diameter. In some examples, the bearing diameter is greater than the work roll diameter, although it need not be. Referring to FIG. 3, each bearing 116A-B includes a first edge 118 and a second edge 120 opposite the first edge 118. A distance from the first edge 118 to the second edge 120 is referred to as a bearing width 119. In some examples, the bearing width 119 is from about 55 mm to about 110 mm. In one non-limiting example, the bearing width 119 is about 100 mm. In some examples, each bearing 116A-B has a profile with a crown or chamfer across the bearing width 119, where crown generally refers to a difference in diameter between a centerline and the edges 118, 120 of the bearing (e.g., the bearing is barrel-shaped). The crown or chamfer may be from about 0 μm to about 50 μm in height. In one non-limiting example, the crown is about 30 μm. In another non-limiting example, the crown is about 20 μm.

In some examples where a plurality of bearings 116A-B are provided, the bearings 116A-B may be arranged in one or more rows. However, the number or configuration of bearing 116A-B should not be considered limiting on the current disclosure. Referring to FIGS. 2 and 3, within each row of bearings 116A-B, adjacent bearings 116A-B are spaced apart by a bearing spacing 121, which is a distance between adjacent ends of adjacent bearings 116A-B. In various examples, the bearing spacing 121 is from about 1 mm to about the width of each bearing. In certain aspects, a density of the bearings 116A-B, or a number of bearings acting on a particular portion of the work rolls 104A-B, may be varied along the work rolls 104A-B. For example, in some cases, the number of bearings 116A-B at edge regions of the work rolls 104A-B may be different from the number of bearings 116A-B at a center region of the work rolls 104A-B.

In various examples, in addition to being vertically adjustable to control bearing load, the bearings 116A-B may also be laterally adjustable relative to the respective work roll 104A-B, meaning that a position of the bearings 116A-B along a width of the respective work roll 104A-B may be adjusted. For example, in examples where the bearings 116A-B are arranged in at least one row, the row includes two edge bearings 117, which are the outermost bearings 116A-B of the row of bearings 116A-B. In some examples, at least the edge bearings 117 are laterally adjustable.

In some examples, a characteristic of the bearings 116A-B may be adjusted or controlled depending on desired location of the particular bearings 116A-B along the width of the work rolls. As one non-limiting example, the crown or chamfer of the bearings 116A-B proximate to edges of the work rolls may be different from the crown or chamfer of the bearings 116A-B towards the center of the work rolls. In other aspects, the diameter, width, spacing, etc. may be controlled or adjusted such that the particular characteristic of the bearings 116A-B may be the same or different depending on location. In some aspects, bearings having different characteristics in the edge regions of the work rolls compared to bearings in the center regions of the work rolls may further allow for uniform pressure or other desired pressure profiles during texturing. For example, in some cases, the bearings may be controlled to intentionally change the flatness and/or texture of the metal substrate 108. As some examples, the bearings 116A-B may be controlled to intentionally create an edge wave, create a thinner edge, etc. Various other profiles may be created.

The mill 100 includes various pressure parameters that affect the contact pressure distribution of the work rolls 104A-B on the metal substrate 108. These pressure parameters include, but are not limited to, the cylindricity of the work rolls 104A-B and/or the intermediate rolls 114A-B, the work roll diameter, the intermediate roll diameter, the bearing diameter, the bearing width 119, the bearing crown, the bearing spacing 121, the bearing load, the bearing load distribution (i.e., applied load profile or distribution of the bearing load along the width of the roll), and the edge bearing 117 position relative to an edge of the metal substrate 108. Some of these pressure parameters may be adjusted and controlled through a controller of a control system 122 and/or may be adjusted and controlled by an operator or user of the mill 100. In various examples, the pressure parameters may be selected and predetermined for installation with a new mill 100. In other examples, the pressure parameters may be adjusted and controlled to retrofit an existing mill 100.

In various examples, the roundness or cylindricity of the work rolls 104A-B and/or the intermediate rolls 114A-B may be adjusted by selecting work rolls 104A-B and/or intermediate rolls 114A-B of a predetermined roundness or cylindricity or by removing the work rolls 104A-B and/or the intermediate rolls 114A-B already installed in the mill 100 and replacing them with replacement work rolls 104A-B and/or replacement intermediate rolls 114A-B having a different, predetermined roundness or cylindricity. The replacement rolls may be more round or less round depending on the needs of the system to provide the desired contact pressure distribution. As noted above, the roundness or cylindricity of each of the rolls may be determined using various dial gauges and/or other indicators positioned at multiple points along the width of the respective roll. In various examples, the roundness or cylindricity of a roll is adjusted such that a variation in cylindricity is less than about 10 μm along the width of the roll (i.e., a variation of from about 0 μm to about 10 μm along the width of the roll).

In some examples, the work roll diameter, intermediate roll diameter, and/or bearing diameter may be adjusted by selecting work rolls 104A-B, intermediate rolls 114A-B, and/or bearings 116A-B of a predetermined diameter or by removing the work rolls 104A-B, intermediate rolls 114A-B, and/or bearings 116A-B already installed in the mill 100 and replacing them with replacement work rolls 104A-B, replacement intermediate rolls 114A-B, and/or replacement bearings 116A-B having a different, predetermined diameter. The replacement work rolls 104A-B, replacement intermediate rolls 114A-B, and/or replacement bearings 116A-B may have an increased diameter or decreased diameter depending on the needs of the system to provide the desired contact pressure distribution. For example, in some cases, the work roll diameter, the intermediate roll diameter, and/or the bearing diameter may be decreased by a factor of 1.5 to decrease the variation of the contact pressure distribution. In other examples, the work roll diameter, the intermediate roll diameter, and/or the bearing diameter are increased by a factor of 2 to decrease the variation of the contact pressure distribution. In various examples, as the diameters increase, the pressure variation of the contact pressure distribution decreases, but the ability to control work roll pressure at discrete locations (i.e. different localized pressures) on the metal substrate 108 is also reduced, and thus edge effects increase.

In various cases, the bearing width 119 and bearing spacing 121 may be adjusted by selecting bearings 116A-B of a predetermined bearing width 119 and spacing them at predetermined bearing spacings and/or by removing the bearings 116A-B already installed in the mill 100 and replacing them with replacement bearings 116A-B having a different, predetermined bearing width 119 and/or a different, predetermined bearing spacing 121. In some cases, the width of the replacement bearings 116A-B may be increased or decreased. In some examples, the predetermined bearing width 119 is from about 20 mm to about 400 mm. For example, in some cases, the bearing width 119 is from about 55 mm to about 110 mm. In various examples, the predetermined bearing width 119 is about 100 mm. The bearing width 119 may be increased or decreased depending on the needs of the system to provide the desired contact pressure distribution. For example, in some cases, the bearing width 119 may be increased to help decrease texture uniformity across the width and at the edges of the metal substrate 108. In other examples, the bearing width 119 may be decreased to help increase the texture uniformity across the width and at the edges of the metal substrate 108.

In various examples, the replacement bearings 116A-B are installed such that lateral positions of the bearings 116A-B relative to the intermediate roll 114A-B are maintained. If the replacement bearings 116A-B have an increased bearing width 119, the bearing spacing 121 between adjacent bearings 116A-B may be reduced. In some examples, the predetermined bearing spacing 121 is a minimum bearing spacing 121 of about 34 mm. Conversely, if the replacement bearings 116A-B have a decreased bearing width 119, the bearing spacing 121 between adjacent bearings 116A-B may be increased. In other examples, the replacement bearings 116A-B are installed such that positions of the bearings 116A-B relative to the intermediate roll 114A-B are laterally adjusted. For example, the replacement bearings 116A-B may be positioned to increase or decrease the bearing spacing 121. In some examples, the predetermined bearing spacing 121 is a minimum bearing spacing 121 of about 34 mm. In other examples, the bearing spacing 121 is from about 1 mm to about the width of a bearing. In various cases, adjusting the bearing spacing 121 includes maintaining the same number of bearings 116A-B in a row along the intermediate rolls 114A-B, respectively. In some further examples, increasing the bearing spacing 121 may further include reducing the number of bearings 116A-B in a row along the intermediate rolls 114A-B, respectively. Conversely, in other optional examples, decreasing the bearing spacing 121 may further include increasing the number of bearings 116A-B in a row along the intermediate rolls 114A-B, respectively. In various examples, bearings with smaller widths 119 and/or reduced bearing spacings 121 decrease the pressure variation of the contact pressure distribution and may help improve uniformity of the work roll pressure and texture at the substrate edges.

The crown of the bearings 116A-B may be adjusted by selecting bearings 116A-B with a predetermined crown or by removing the bearings 116A-B already installed with the mill 100 and replacing them with replacement bearings 116A-B having a different, predetermined crown. For example, bearings 116A-B with increased crowns may be provided to increase pressure variation of the contact pressure distribution. Bearings 116A-B with decreased crowns may be provided to decrease pressure variation of the contact pressure distribution. In various examples, the predetermined bearing crown is from about 0 m to about 50 m.

The bearing load may be adjusted by vertically adjusting one or more of the bearings 116A-B relative to their respective work rolls 104A-B such that the bearing load profile (i.e., the distribution of the bearing loads along the width of the work rolls 104A-B), and therefore the work roll pressure, is adjusted at localized areas (i.e., localized pressures at particular areas are adjusted). In some examples, the vertical position of the bearings 116A-B relative to the work rolls 104A-B, respectively, may be controlled through the controller. In other examples, an operator may control the vertical position of the bearings 116A-B. In some examples, the bearings 116A-B or a subset of the bearings 116A-B are vertically adjusted away from the respective work rolls 104A-B to reduce the bearing load and therefore to reduce the work roll pressure on the metal substrate 108 at localized areas (i.e., the localized pressure at a particular area or areas is reduced). In other examples, the bearings 116A-B or a subset of the bearings 116A-B are vertically adjusted toward the respective work rolls 104A-B to increase the bearing load and therefore to increase the work roll pressure on the metal substrate 108 at localized areas (i.e., the localized pressure at a particular area or areas is increased). The bearings 116A-B or a subset of the bearings 116A-B may be adjusted such that the load on each bearing 116A-B is from about 2 kgf to about 20,000 kgf. As one non-limiting example, the load on each bearing 116A-B may be from about 300 kgf to about 660 kgf. In some examples, the bearings 116A-B, or a subset of the bearings 116A-B, are adjusted such that the work roll pressure at one or more localized areas is about 610 kgf. In various examples, the load on each bearing 116A-B may depend on the dimensions of the bearing, a hardness of the substrate 108, and/or the desired texture.

As noted above, each of the bearings 116A-B may be individually adjusted, or sets of the bearings 116A-B may be adjusted together. For example, in some cases, vertically adjusting the bearings 116A-B includes vertically adjusting all of the bearings 116A-B. In other examples, each bearing 116A-B is individually adjusted. For example, in some cases, the edge bearing 117 is vertically adjusted relative to the edges of the metal substrate 108 to adjust the localized pressure at the edge portions of the metal substrate 108. The vertical adjustment of the edge bearings 117 may be different from the vertical adjustment of the other bearings 116A-B that indirectly apply a load to the non-edge portions of the metal substrate 108. Vertically adjusting the edge bearings 117 may include vertically moving the edge bearings 117 toward the work rolls 104A-B to increase the localized pressure at the edge portions of the metal substrate 108. Vertically adjusting the edge bearings 117 may also include vertically moving the edge bearings 117 away from the work rolls 104A-B to decrease the localized pressure at the edge portions of the metal substrate 108.

The edge bearing 117 lateral position relative to an edge of the metal substrate 108 also may be adjusted through the controller or an operator. It was surprisingly found that by controlling a position of the edge-portion of the metal substrate 108 relative to the first edge 118 and the second edge 120 of the edge bearing 117, the edge effects could be controlled. In some examples, the edge bearings 117 are laterally adjusted such that the edge of the metal substrate 108 is between the first edge 118 and an intermediate position between the first edge 118 and the second edge 120. In other examples, the edge bearing 117 is laterally adjusted such that the edge of the metal substrate 108 is between the second edge 120 and the intermediate position between the first edge 118 and the second end 120. In various examples, the edge bearing 117 is laterally adjusted such that the edge of the metal substrate 108 is laterally outward from the second edge 120 (i.e., at least some of the metal substrate 108 extends beyond the edge bearing 117).

By adjusting one or more of the above pressure parameters of the mill 100, a desired contact pressure distribution of the work rolls 104A-B on the metal substrate 108 can be provided to result in a metal substrate 108 with improved texture consistency, or a more uniform texture over the surface and across the width of the metal substrate 108. In some examples, the pressure parameters are adjusted and controlled such that a thickness of the metal substrate 108 remains substantially constant. In various examples, one or more pressure parameters are controlled to provide a desired contact pressure distribution that both minimizes pressure variation and reduces edge effects of the metal substrate 108 that occur during texturing.

In some examples, the control system 122 includes a controller (not shown), which may be any suitable processing device, and one or more sensors 124. The number and location of the sensors 124 shown in FIG. 1 is for illustration purposes only and can vary as desired. The sensors 124 are configured to monitor the rolling mill 100 and/or stand processing conditions. For example, in some cases, the sensors 124 monitor the contact pressure distribution of the work rolls 104A-B on the metal substrate 108. Depending on the sensed contact pressure distribution, one or more pressure parameters are adjusted (through the controller and/or the mill operator or otherwise) to provide the desired contact pressure distribution. In some examples, the one or more pressure parameters are adjusted such that pressure variation and edge effects are minimized without changing the thickness of the metal substrate 108. In some examples, the one or more pressure parameters are adjusted such that a more uniform texture of the metal substrate 108 is achieved.

In various examples, a method of applying a texture to the metal substrate 108 includes passing the metal substrate 108 through the gap 106. As the metal substrate 108 passes through the gap 106, the work rolls 104A-B apply work roll pressure to the upper surface 110 and the lower surface 112 of the metal substrate 108 across the width of the metal substrate 108 such that the texture of the one or more work rolls 104A-B is transferred to the metal substrate 108 while the thickness of the metal substrate remains substantially constant. In some examples, the method includes measuring the contact pressure distribution across the width of the metal substrate 108 with at least one of the sensors 124 and receiving data from the sensor at the processing device of the control system 122. In various examples, the method includes maintaining or adjusting at least one pressure parameter of the mill 100 such that the work roll pressure applied by the work rolls 104A-B across the width of the metal substrate 108 provides the desired contact pressure distribution across the width of the metal substrate 108 and the thickness of the metal substrate 108 remains substantially constant.

In some examples, at least one of the pressure parameters is adjusted to provide a pressure variation of the contact pressure distribution over the surface and across the width of the metal substrate 108 that is less than a certain percentage. For example, in some cases, at least one of the pressure parameters is adjusted such that the pressure variation of the contact pressure distribution across the width of the metal substrate 108 is less than about 25%. In other cases, at least one of the pressure parameters is adjusted such that the pressure variation of the contact pressure distribution across the width of the metal substrate 108 is less than about 13%. In further examples, at least one of the pressure parameters is adjusted such that the pressure variation of the contact pressure distribution across the width of the metal substrate 108 is less than about 8%. By reducing the variation of the contact pressure distribution across the width of the metal substrate 108, the texture transferred to the metal substrate 108 is more uniform with respect to at least one texture characteristic compared to textures applied under contact pressure distributions having greater variation.

One or more pressure parameters described above may be adjusted to provide the desired contact pressure distribution that both minimizes pressure variation and reduces edge effects of the metal substrate 108 from processing to provide a more uniform texture along the metal substrate 108 while an overall thickness of the metal substrate 108 remains substantially constant. As one non-limiting example, to provide the desired contact pressure distribution, the method may include at least one of increasing the work roll diameter and/or the intermediate roll diameter, reducing the bearing spacing 121 to the minimum bearing spacing 121, and positioning the edge bearings 117 such that the edge of the metal substrate 108 extends beyond the second edge 120 of the edge bearing 117. As another non-limiting example, to provide the desired contact pressure distribution, the applied load profile (i.e., the distribution of load over the bearings along the width of the roll configuration) is adjusted to obtain a desired work roll pressure and texture across the width of the substrate 108.

Figure 4:
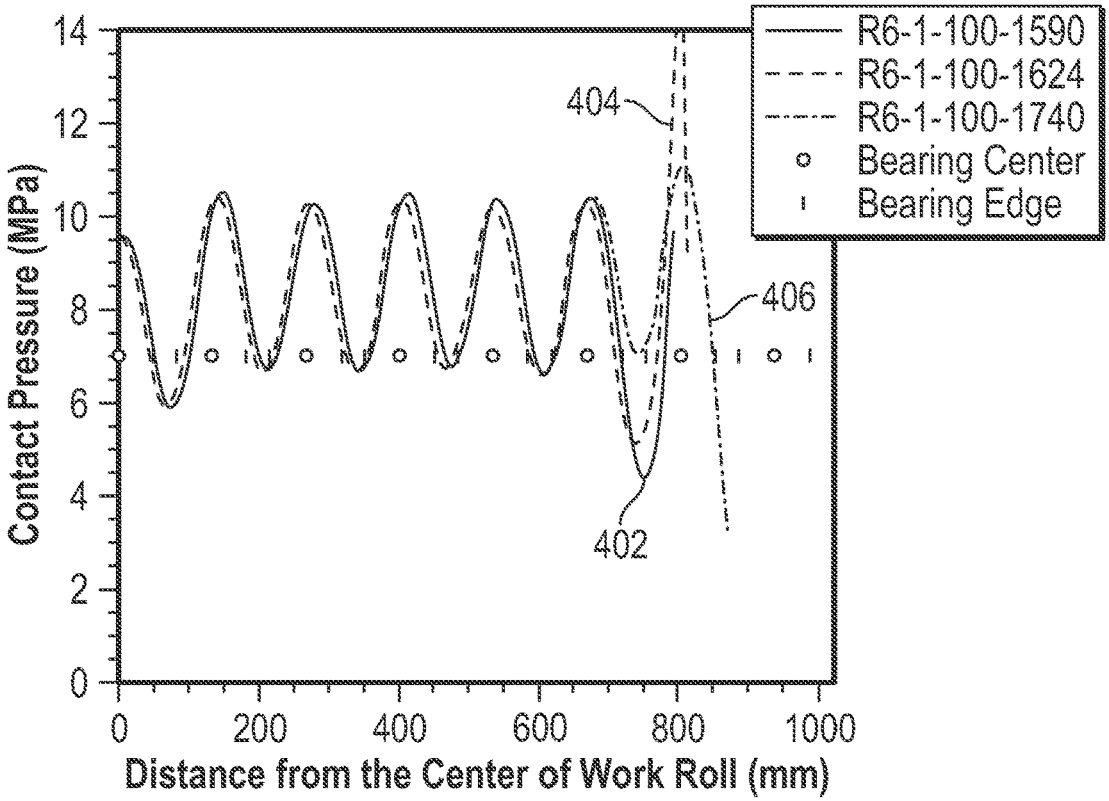
FIG. 4 is a graph of a contact pressure distribution of a work roll on three metal substrates according to an example of the present disclosure.
Figure 5:
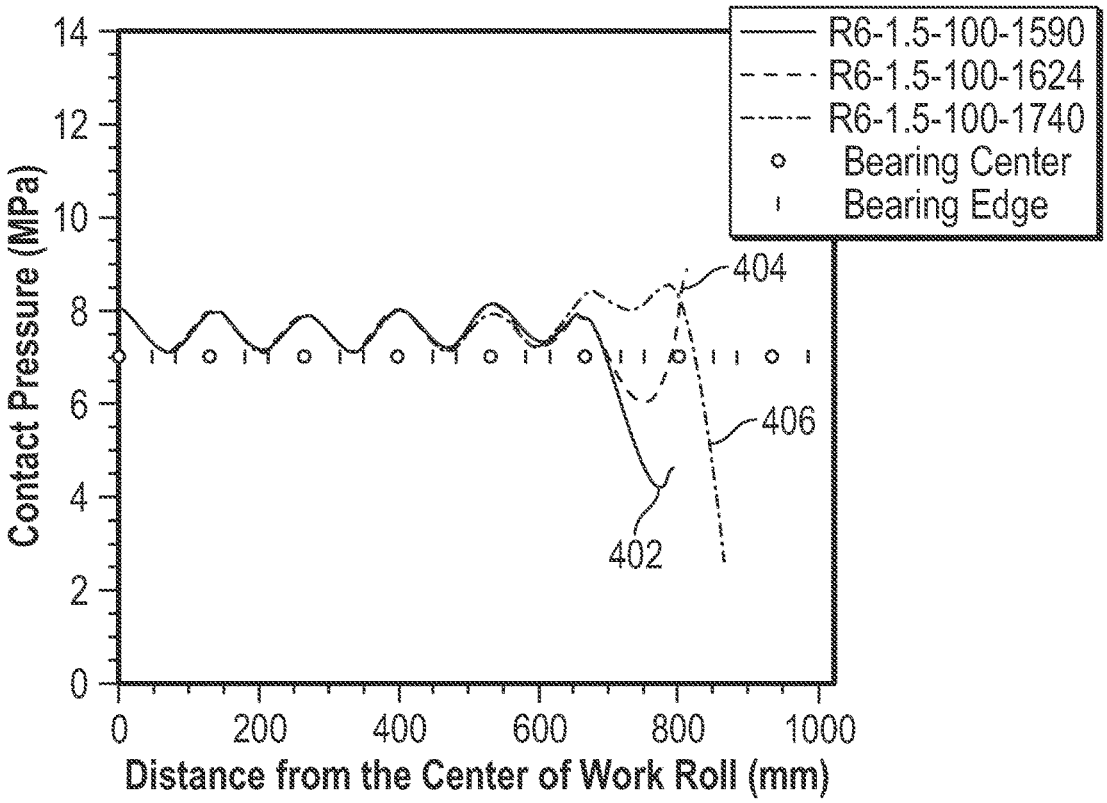
FIG. 5 is a graph of another contact pressure distribution of a work roll on three metal substrates according to an example of the present disclosure.
Figure 6:
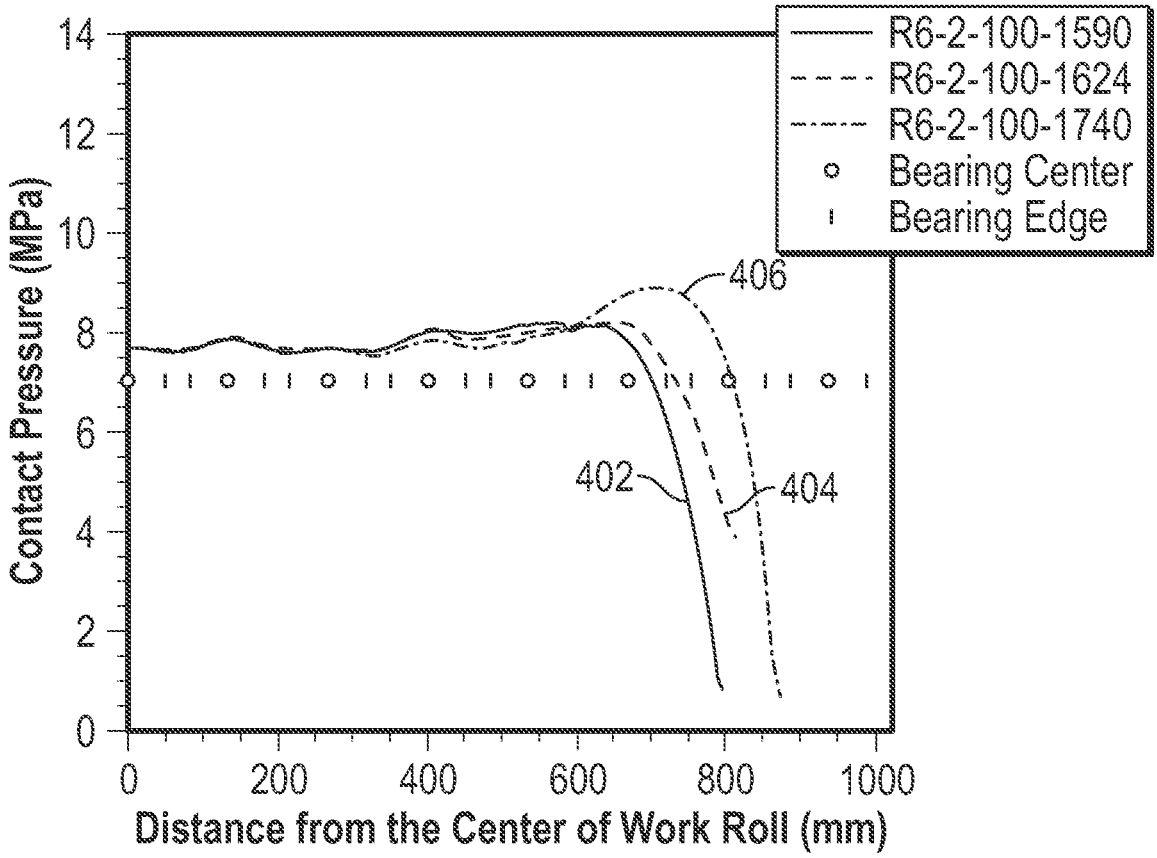
FIG. 6 is a graph of another contact pressure distribution of a work roll on three metal substrates according to an example of the present disclosure.

FIGS. 4-6 illustrate examples of the effect of adjusting two exemplary pressure parameters (roll diameter and position of the edge bearing 117 relative to the edge of the metal substrate 108) on contact pressure distribution. In each of FIGS. 4-6, line 402 represents the pressure distribution of a metal substrate where the edge of the metal substrate 108 is between the first edge 118 and an intermediate position between the first edge 118 and the second edge 120. Line 404 in each of FIGS. 4-6 represents the pressure distribution of a metal substrate where the edge of the metal substrate 108 is between the second edge 120 and the intermediate position between the first edge 118 and the second edge 120. Line 404 in each of FIGS. 4-6 represents the pressure distribution of a metal substrate where the edge of the metal substrate 108 extends outward from the second edge 120.

For the line 402 in all of FIGS. 4-6, eight bearings are illustrated. For bearings 1-6, the localized pressure applied by each bearing was 610 kgf. For bearing 7, the localized pressure applied was 610/4 kgf. Bearing 8 was fixed in the y direction, meaning that no localized pressure was applied.

For the line 404, in all of FIGS. 4-6, eight bearings are illustrated. For bearings 1-6, the localized pressure applied by each bearing was 610 kgf. For bearing 7, the localized pressure applied was 610/2 kgf. Bearing 8 was fixed in the y direction, meaning that no localized pressure was applied.

For line 406, in all of FIGS. 4-6, eight bearings are illustrated. For bearings 1-7, the localized pressure applied by each bearing was 610 kgf. Bearing 8 was fixed in the y direction, meaning that no localized pressure was applied.

In FIG. 4, the diameters of the work rolls applying the work roll pressure to each of the metal substrates are the same. In FIG. 5, the work roll diameters are increased by a factor of 1.5 relative to the work roll diameters of FIG. 4. In FIG. 6, the work roll diameters are increased by a factor of 2 relative to the work roll diameters of FIG. 4.

In general, for any of lines 402, 404, or 406, FIG. 4 illustrates increased variation in the contact pressure distribution as well as increased edge effects (e.g., represented by the pressure variation starting at bearing 7). For any of lines 402, 404, or 406, FIG. 6 illustrates the best control of pressure variation (i.e., the variation of the contact pressure distribution is minimized), but the edge effects are increased. Of the FIGS. 4-6, for any of lines 402, 404, or 406, FIG. 5 illustrates the best combination of minimized pressure variation while reducing edge effects in the contact pressure distribution.

Therefore, the disclosed system can be used to achieve a more uniform texture on a metal substrate by adjusting the one or more pressure parameters to produce a contact pressure distribution that minimizes pressure variation while reducing edge effects. By optimizing the pressure parameters to produce the desired contact pressure distribution, metal substrates with improved texture uniformity may be produced.

In some examples, one side of the work stand may be frozen such that only one side of the stand is actuated (i.e., the stand is actuated only in the direction 103 or only in the direction 105). In such examples, the vertical position of the lower work roll 104B is constant, fixed, and/or does not move vertically against the metal substrate.

Figure 7:
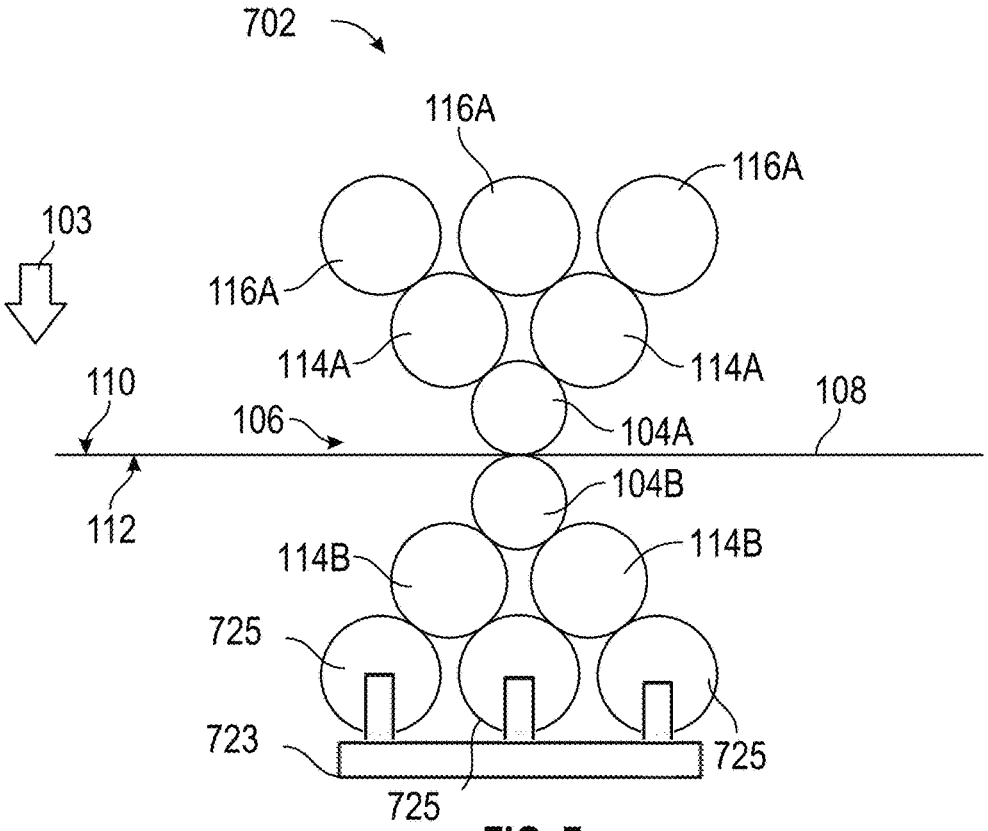
FIG. 7 is a schematic a work stand according to aspects of the present disclosure.
Figure 8:
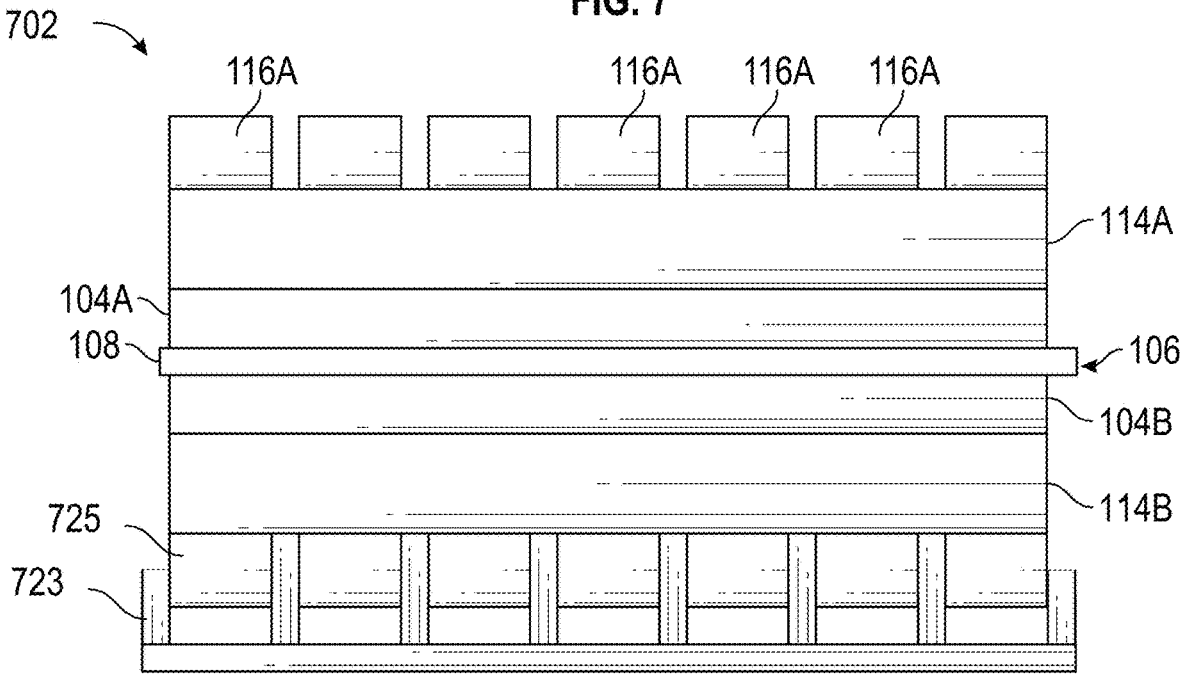
FIG. 8 is a schematic end view of the work stand of FIG. 7.
Figure 9:
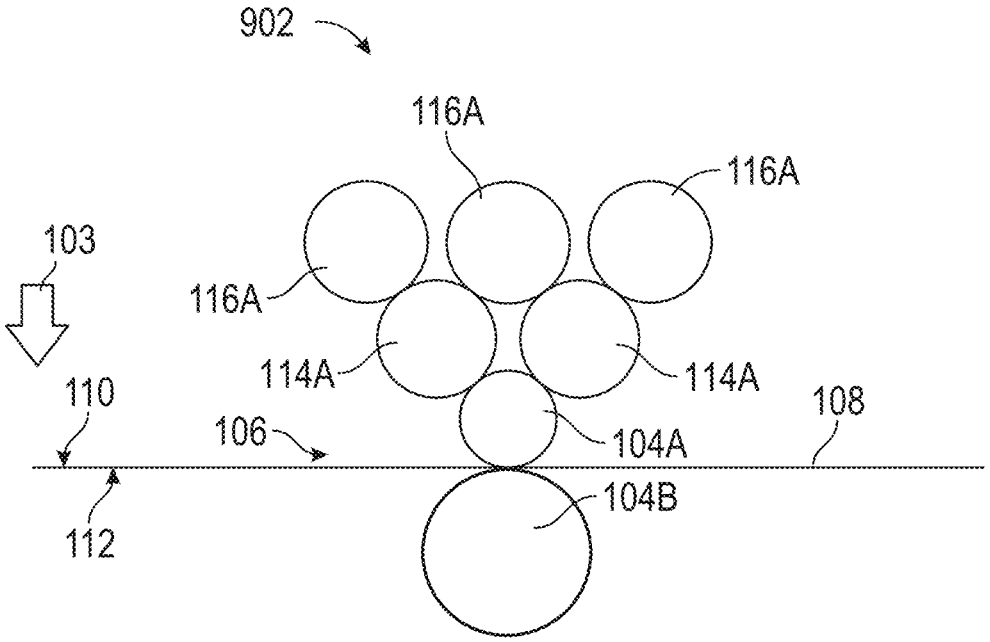
FIG. 9 is a schematic of a work stand according to aspects of the present disclosure.
Figure 10:
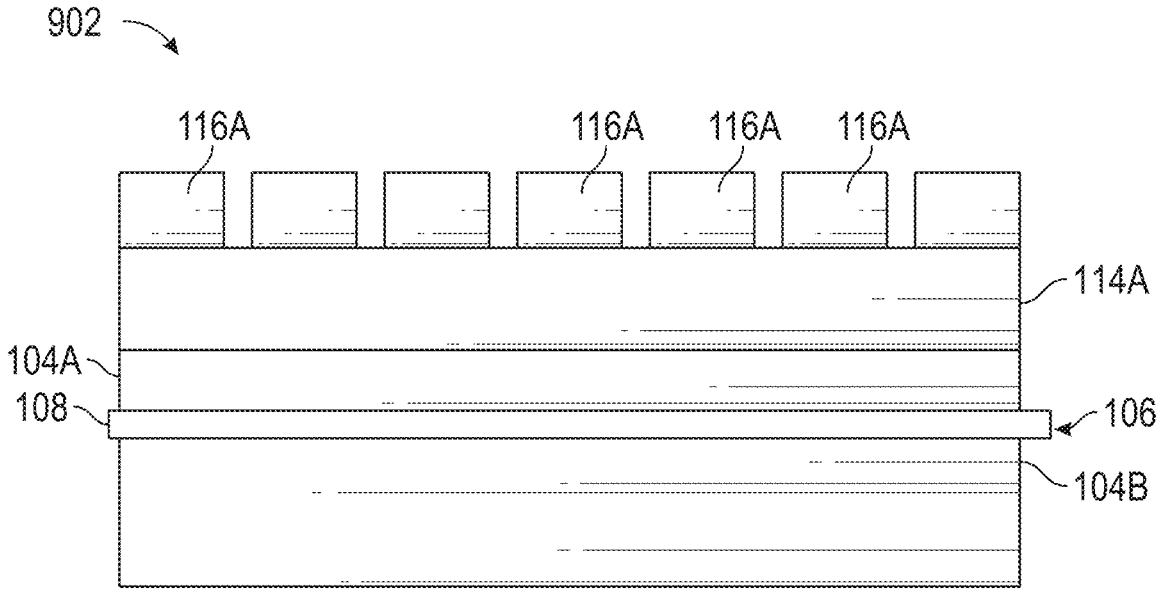
FIG. 10 is a schematic end view of the work stand of FIG. 9.

In some aspects where bearings are included on both the upper and lower sides of the stand, one side of the work stand may be frozen by controlling one set of bearings such that they are not actuated. For example, in some cases, the lower bearings 116B may be frozen such that the lower work roll 104B not actuated in the direction 105. In other examples, the lower bearings 116B may be omitted such that the lower work roll 104B is frozen. In other examples, various other mechanisms may be utilized such that one side of the stand is frozen. For example, FIGS. 7 and 8 illustrate an additional example of a work stand where one side is frozen, and FIGS. 9 and 10 illustrate a further example of a work stand where one side is frozen. Various other suitable mechanisms and/or roll configurations for freezing one side of the work stand while providing the necessary support to the frozen side of the work stand may be utilized.

FIGS. 7 and 8 illustrate another example of a work stand 702. The work stand 702 is substantially similar to the work stand 102 except that the work stand 702 includes fixed backup rolls 725 in place of the lower bearings 116B. In this example, the fixed backup rolls 725 are not vertically actuated, and as such the work stand 702 is only actuated in the direction 103. Optionally, the backup rolls 725 are supported on a stand 723 or other suitable support as desired. Optionally, the stand 723 supports each backup roll 725 at one or more locations along the backup roll 725. In the example of FIGS. 7 and 8, three backup rolls 725 are provided; however, in other examples, any desired number of backup rolls 725 may be provided. In these examples, because the backup rolls 725 are vertically fixed, the lower work roll 104B is frozen, meaning that the lower work roll 104*b* is constant, fixed, and/or does not move vertically against the metal substrate. In such examples, the actuation in the stand 702 during texturing is only from one side of the stand 702 (i.e., actuation is only from the upper side of the stand with the upper work roll 104A).

FIGS. 9 and 10 illustrate another example of a work stand 902. The work stand 902 is substantially similar to the work stand 102 except that the intermediate rolls and actuators are omitted, and a diameter of the lower work roll 104B is greater than the diameter of the upper work roll 104A. In this example, the work stand 1202 is only actuated in the direction 103. In some aspects, the larger diameter lower work roll 104B provides the needed support against the actuation such that the desired profile of the metal substrate 108 is created during texturing. It will be appreciated that in other examples, intermediate rolls and/or various other support rolls may be provided with the lower work roll 104B. In further examples, the lower work roll 104B may have a similar diameter as the upper work roll 104A and the work stand further includes any desired number of intermediate rolls and/or support rolls to provide the necessary support to the lower work roll 104B when one side is frozen.

A collection of exemplary embodiments, including at least some explicitly enumerated as "ECs" (Example Combinations), providing additional description of a variety of embodiment types in accordance with the concepts described herein are provided below. These examples are not meant to be mutually exclusive, exhaustive, or restrictive; and the invention is not limited to these example embodiments but rather encompasses all possible modifications and variations within the scope of the issued claims and their equivalents.

EC 1. A method of applying a texture on a substrate, the method comprising: applying a texture to a substrate with a work stand of a coil-to-coil process, wherein the work stand comprises an upper work roll and a lower work roll vertically aligned with the upper work roll, wherein at least one of the upper work roll and the lower work roll comprises the texture, and wherein applying the texture comprises: applying, by the upper work roll, a first work roll pressure on an upper surface of the substrate; and applying, by the lower work roll, a second work roll pressure on a lower surface of the substrate; measuring a contact pressure distribution of at least one of the first work roll pressure and the second work roll pressure across a width of the substrate with a sensor; receiving data at a processing device from the sensor; and adjusting a contact pressure parameter of the work stand such that the work stand provides a desired contact pressure distribution across the width of the substrate and a thickness of the substrate remains substantially constant after the texture has been applied.

EC 2. The method of any of the preceding or subsequent examples, wherein adjusting the contact pressure parameter adjusts at least one characteristic of the texture on the substrate.

EC 3. The method of any of the preceding or subsequent examples, wherein the at least one characteristic comprises a height of the texture, a depth of the texture, a shape of the texture, a size of the texture, a distribution of the texture, a coarseness of the texture, or a concentration of the texture.

EC 4. The method of any of the preceding or subsequent examples, wherein adjusting the contact pressure parameter comprises providing the desired contact pressure distribution having a contact pressure variation across the width of the substrate of less than 25%.

EC 5. The method of any of the preceding or subsequent examples, wherein the contact pressure variation across the width of the substrate is less than 13%.

EC 6. The method of any of the preceding or subsequent examples, wherein the contact pressure variation across the width of the substrate is less than 8%.

EC 7. The method of any of the preceding or subsequent examples, wherein adjusting the contact pressure parameter comprises adjusting a cylindricity of the work rolls such that a variation of cylindricity is less than 10 m.

EC 8. The method of any of the preceding or subsequent examples, wherein the work stand further comprises an upper intermediate roll supporting the upper work roll and a lower intermediate roll supporting the lower work roll.

EC 9. The method of any of the preceding or subsequent examples, wherein adjusting the contact pressure parameter comprises adjusting a cylindricity of the intermediate rolls such that a variation of cylindricity is less than 10 m.

EC 10. The method of any of the preceding or subsequent examples, wherein the work rolls have a work roll diameter and the intermediate rolls have an intermediate roll diameter, and wherein adjusting the contact pressure parameter comprises adjusting at least one of the work roll diameter and the intermediate roll diameter.

EC 11. The method of any of the preceding or subsequent examples, wherein the work roll diameter is from about 20 mm to about 200 mm, and wherein the intermediate roll diameter is from about 20 mm to about 300 mm.

EC 12. The method of any of the preceding or subsequent examples, wherein adjusting the contact pressure parameter comprises increasing at least one of the work roll diameter and the intermediate roll diameter by a factor of 1.5.

EC 13. The method of any of the preceding or subsequent examples, wherein adjusting the contact pressure parameter comprises increasing at least one of the work roll diameter and the intermediate roll diameter by a factor of 2.

EC 14. The method of any of the preceding or subsequent examples, wherein the upper intermediate roll is a first upper intermediate roll, wherein the lower intermediate roll is a first lower intermediate roll, and wherein the work stand further comprises: a second upper intermediate roll supporting the upper work roll; and a second lower intermediate role supporting the lower work roll.

EC 15. The method of any of the preceding or subsequent examples, wherein the work stand further comprises: a set of upper bearings along the upper intermediate roll, each upper bearing applying a bearing load to the upper intermediate roll such that the upper intermediate roll causes the upper work roll to apply the first work roll pressure on the substrate; and a set of lower bearings along the lower intermediate roll, each lower bearing applying a bearing load to the lower intermediate roll such that the lower intermediate roll causes the lower work roll to apply the second work roll pressure on the substrate.

EC 16. The method of any of the preceding or subsequent examples, wherein the set of upper bearings comprises at least two rows of upper bearings, and wherein the set of lower bearings comprises at least two rows of lower bearings.

EC 17. The method of any of the preceding or subsequent examples, wherein adjusting the contact pressure parameter comprises adjusting a spacing between adjacent upper bearings.

EC 18. The method of any of the preceding or subsequent examples, wherein adjusting the spacing comprises decreasing the spacing between adjacent upper bearings by changing a lateral position of at least one of the upper bearings relative to an adjacent upper bearing.

EC 19. The method of any of the preceding or subsequent examples, wherein decreasing the spacing comprises decreasing the spacing to a minimum spacing of about 1 mm.

EC 20. The method of any of the preceding or subsequent examples, wherein decreasing the spacing comprises increasing a number of upper bearings along the upper intermediate roll.

EC 21. The method of any of the preceding or subsequent examples, wherein adjusting the contact pressure parameter comprises adjusting a bearing dimension of at least one upper bearing of the set of upper bearings.

EC 22. The method of any of the preceding or subsequent examples, wherein adjusting the bearing dimension comprises changing at least one of a bearing width or a bearing diameter.

EC 23. The method of any of the preceding or subsequent examples, wherein the bearing width is from about 20 mm to about 400 mm, and wherein the bearing diameter is from about 20 mm to about 400 mm.

EC 24. The method of any of the preceding or subsequent examples, wherein the bearing width is about 100 mm.

EC 25. The method of any of the preceding or subsequent examples, wherein adjusting the bearing dimension comprises increasing a bearing width while maintaining lateral positions of the upper bearings, wherein increasing the bearing width decreases a spacing between adjacent upper bearings.

EC 26. The method of any of the preceding or subsequent examples, wherein increasing the bearing width comprises reducing a number of upper bearings along the upper intermediate roll.

EC 27. The method of any of the preceding or subsequent examples, wherein adjusting the contact pressure parameter comprises reducing a crown or chamfer height of each one of the upper bearings or lower bearings to be less than about 50 μm.

EC 28. The method of any of the preceding or subsequent examples, wherein adjusting the contact pressure parameter comprises decreasing the crown or chamfer height of each one of the upper bearings or lower bearings to about 20 μm.

EC 29. The method of any of the preceding or subsequent examples, wherein each one of the upper bearings is individually adjustable relative to the upper intermediate roll, and wherein adjusting the contact pressure parameter comprises increasing the bearing load applied by at least one of the upper bearings on the upper intermediate roll.

EC 30. The method of any of the preceding or subsequent examples, wherein adjusting the contact pressure parameter comprises increasing the bearing load applied by all of the upper bearings on the upper intermediate roll.

EC 31. The method of any of the preceding or subsequent examples, wherein the set of upper bearings comprises an outermost upper bearing having an inner end and an outer end, and wherein adjusting the contact pressure parameter comprises adjusting the outermost upper bearing relative to an edge of the substrate.

EC 32. The method of any of the preceding or subsequent examples, wherein adjusting the outermost upper bearing comprises moving the outermost upper bearing such that the edge of the substrate is between the inner end and an intermediate position of the outermost upper bearing, wherein the intermediate position is between the outer end and the inner end.

EC 33. The method of any of the preceding or subsequent examples, wherein adjusting the outermost upper bearing comprises moving the outermost upper bearing such that the edge of the substrate is between the outer end and an intermediate position of the outermost upper bearing, wherein the intermediate position is between the outer end and the inner end.

EC 34. The method of any of the preceding or subsequent examples, wherein adjusting the outermost upper bearing comprises moving the outermost upper bearing such that the edge of the substrate extends axially outward from the outer end of the outermost upper bearing.

EC 35. The method of any of the preceding or subsequent examples, wherein adjusting the outermost upper bearing comprises increasing the bearing load applied by the outermost upper bearing to the upper intermediate roll to cause the upper work roll to increase the work roll pressure at the edge of the substrate.

EC 36. The method of any of the preceding or subsequent examples, wherein the first work roll pressure and the second work roll pressure are from about 1 MPa to about a yield strength of the substrate.

EC 37. The method of any of the preceding or subsequent examples, wherein a variation in thickness across the width of the substrate is less than 2% after the texture has been applied.

EC 38. The method of any of the preceding or subsequent examples, wherein the work stand is a first work stand, the upper work roll is a first upper work roll, the texture is a first texture, and the lower work roll is a first lower work roll, and wherein the method further comprises: applying a second texture to a substrate with a second work stand of the coil-to-coil process, wherein the second work stand comprises a second upper work roll and a second lower work roll vertically aligned with the second upper work roll, wherein at least one of the second upper work roll and the second lower work roll comprises the second texture, and wherein applying the second texture comprises: applying, by the second upper work roll, a third work roll pressure on the upper surface of the substrate; and applying, by the second lower work roll, a fourth work roll pressure on a lower surface of the substrate, wherein the thickness of the substrate remains substantially constant after the second texture has been applied.

EC 39. The method of any of the preceding or subsequent examples, wherein the first work roll pressure and the second work roll pressure are less than a yield strength of the substrate.

EC 40. The substrate formed from the method of any of the preceding or subsequent examples.

EC 41. The method of any of the preceding or subsequent examples, wherein the thickness of the substrate decreases by no more than 1% after the texture has been applied.

EC 42. The method of any of the preceding or subsequent examples, wherein the thickness of the substrate decreases by no more than 0.5% after the texture has been applied.

EC 43. The method of any of the preceding or subsequent examples, wherein the first work roll pressure and the second work roll pressure are substantially the same.

EC 44. A coil-to-coil processing system comprising: a work stand comprising: an upper work roll configured to apply a first work roll pressure on an upper surface of a substrate; and a lower work roll vertically aligned with the upper work roll and configured to apply a second work roll pressure on a lower surface of the substrate, wherein at least one of the upper work roll and the lower work roll comprises a texture such that at least one of the upper work roll and the lower work roll are configured to impart the texture on the substrate by applying the first work roll pressure or applying the second work roll pressure; and a sensor configured to measure a contact pressure distribution of at least one of the first work roll pressure and the second work roll pressure across a width of the substrate; a processing device configured to receive data from the sensor; and a contact pressure parameter, wherein the contact pressure parameter is adjustable based on the measured contact pressure distribution to achieve a desired contact pressure distribution across the width of the substrate and a thickness of the substrate remains substantially constant after the texture has been applied.

EC 45. The coil-to-coil processing system of any of the preceding or subsequent examples, wherein the contact pressure parameter comprises a cylindricity of the work rolls, and wherein the work rolls comprise a variation in cylindricity of less than about 10 μm along a width of the work rolls.

EC 46. The coil-to-coil processing system of any of the preceding or subsequent examples, wherein the work stand further comprises an upper intermediate roll supporting the upper work roll and a lower intermediate roll supporting the lower work roll.

EC 47. The coil-to-coil processing system of any of the preceding or subsequent examples, wherein the contact pressure parameter comprises a cylindricity of the intermediate rolls, and wherein the intermediate rolls comprise a variation in cylindricity of less than about 10 μm along a width of the intermediate rolls.

EC 48. The coil-to-coil processing system of any of the preceding or subsequent examples, wherein the work rolls have a work roll diameter and the intermediate rolls have an intermediate roll diameter, and wherein the contact pressure parameter comprises at least one of the work roll diameter and the intermediate roll diameter.

EC 49. The coil-to-coil processing system of any of the preceding or subsequent examples, wherein the work roll diameter is from about 20 mm to about 200 mm, and wherein the intermediate roll diameter is from about 20 mm to about 300 mm.

EC 50. The coil-to-coil processing system of any of the preceding or subsequent examples, wherein the upper intermediate roll is a first upper intermediate roll, wherein the lower intermediate roll is a first lower intermediate roll, wherein the work stand further comprises: a second upper intermediate roll supporting the upper work roll; and a second lower intermediate role supporting the lower work roll.

EC 51. The coil-to-coil processing system of any of the preceding or subsequent examples, wherein the work stand further comprises: a set of upper bearings along the upper intermediate roll, each upper bearing configured to apply a bearing load to the upper intermediate roll such that the upper intermediate roll causes the upper work roll to apply the first work roll pressure on the substrate; and a set of lower bearings along the lower intermediate roll, each lower bearing configured to apply a bearing load to the lower intermediate roll such that the lower intermediate roll causes the lower work roll to apply the second work roll pressure on the substrate.

EC 52. The coil-to-coil processing system of any of the preceding or subsequent examples, wherein the set of upper bearings comprises at least two rows of upper bearings, and wherein the set of lower bearings comprises at least two rows of lower bearings.

EC 53. The coil-to-coil processing system of any of the preceding or subsequent examples, wherein the contact pressure parameter comprises a spacing between adjacent upper bearings.

EC 54. The coil-to-coil processing system of any of the preceding or subsequent examples, wherein the spacing is about 34 mm.

EC 55. The coil-to-coil processing system of any of the preceding or subsequent examples, wherein the contact pressure parameter comprises a bearing dimension of at least one upper bearing of the set of upper bearings.

EC 56. The coil-to-coil processing system of any of the preceding or subsequent examples, wherein the bearing dimension comprises a bearing diameter and a bearing width.

EC 57. The coil-to-coil processing system of any of the preceding or subsequent examples, wherein the bearing diameter is from about 20 mm to about 400 mm, and wherein the bearing width is from about 20 mm to about 400 mm.

EC 58. The coil-to-coil processing system of claim 56, wherein the bearing width is about 100 mm.

EC 59. The coil-to-coil processing system of any of the preceding or subsequent examples, wherein the contact pressure parameter comprises a crown or chamfer height of each one of the upper bearings or the lower bearings to be less than about 50 μm.

EC 60. The coil-to-coil processing system of any of the preceding or subsequent examples, wherein the crown of each one of the upper bearings or the lower bearings is about 20 am.

EC 61. The coil-to-coil processing system of any of the preceding or subsequent examples, wherein each one of the upper bearings is individually adjustable relative to the upper intermediate roll, and wherein the contact pressure parameter comprises the bearing load applied by at least one of the upper bearings on the upper intermediate roll.

EC 62. The coil-to-coil processing system of any of the preceding or subsequent examples, wherein the contact pressure parameter comprises the bearing load applied by all of the upper bearings on the upper intermediate roll.

EC 63. The coil-to-coil processing system of any of the preceding or subsequent examples, wherein the set of upper bearings comprises an outermost upper bearing having an inner end and an outer end, and wherein the contact pressure parameter comprises a position of the outermost upper bearing relative to an edge of the substrate.

EC 64. The coil-to-coil processing system of any of the preceding or subsequent examples, wherein the outermost upper bearing is positioned such that the edge of the substrate is between the inner end and an intermediate position of the outermost upper bearing, wherein the intermediate position is between the outer end and the inner end.

EC 65. The coil-to-coil processing system of any of the preceding or subsequent examples, wherein the outermost upper bearing is positioned such that the edge of the substrate is between the outer end and an intermediate position of the outermost upper bearing, wherein the intermediate position is between the outer end and the inner end.

EC 66. The coil-to-coil processing system of any of the preceding or subsequent examples, wherein the outermost upper bearing is positioned such that the edge of the substrate extends axially outward from the outer end of the outermost upper bearing.

EC 67. The coil-to-coil processing system of any of the preceding or subsequent examples, wherein a variation in thickness across the width of the substrate is less than 2% after the texture is applied.

EC 68. The coil-to-coil processing system of any of the preceding or subsequent examples, wherein the first work roll pressure and the second work roll pressure are less than a yield strength of the substrate.

EC 69. The method of any of the preceding or subsequent examples, wherein adjusting the contact pressure parameter comprises adjusting the bearing loads applied by the upper bearings on the upper intermediate roll to adjust a distribution of the bearing loads.

EC 70. The system or method of any of the preceding or subsequent example combinations, wherein the upper work roll is vertically adjustable and wherein the lower work roll is vertically fixed such that only the upper work roll is actuatable.

The above-described aspects are merely possible examples of implementations, merely set forth for a clear understanding of the principles of the present disclosure. Many variations and modifications can be made to the above-described example(s) without departing substantially from the spirit and principles of the present disclosure. All such modifications and variations are included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed is:

1. A method of applying a texture on a substrate, the method comprising:

applying a texture to a substrate with a work stand of a coil-to-coil process, wherein the work stand comprises an upper work roll and a lower work roll vertically aligned with the upper work roll, wherein at least one of the upper work roll and the lower work roll comprises the texture, wherein at least one of the upper work roll or the lower work roll comprises a plurality of discrete locations along a width of the upper work roll or the lower work roll, wherein each discrete location comprises the texture, and wherein applying the texture comprises:

applying, by the upper work roll, a first work roll pressure on an upper surface of the substrate; and applying, by the lower work roll, a second work roll pressure on a lower surface of the substrate;

measuring an actual contact pressure distribution of at least one of the first work roll pressure and the second work roll pressure across a width of the substrate with a sensor;

receiving data at a processing device from the sensor about the actual contact pressure distribution;

comparing the actual contact pressure distribution with a desired contact pressure distribution;

identifying an adjustable contact pressure parameter of the work stand based on a difference between the actual contact pressure distribution and the desired contact pressure distribution; and adjusting the identified adjustable contact pressure parameter of the work stand such that the actual contact pressure distribution work stand provides the desired contact pressure distribution across the width of the substrate and a thickness of the substrate remains substantially constant after the texture has been applied, wherein adjusting the contact pressure parameter comprises adjusting the identified contact pressure parameter independently at each discrete location of the plurality of discrete locations.

2. The method of claim 1, wherein adjusting the contact pressure parameter adjusts at least one characteristic of the texture on the substrate, and wherein the at least one characteristic comprises at least one of a height of the texture, a depth of the texture, a shape of the texture, a size of the texture, a distribution of the texture, a coarseness of the texture, or a concentration of the texture.

3. The method of claim 1, wherein adjusting the contact pressure parameter comprises providing the desired contact pressure distribution having a contact pressure variation across the width of the substrate of less than 25%.

4. The method of claim 1, wherein adjusting the contact pressure parameter comprises adjusting a cylindricity of the work rolls such that a variation of cylindricity is less than 10 μm.

5. The method of claim 1, wherein the work stand further comprises an upper intermediate roll supporting the upper work roll.

6. The method of claim 5, wherein the work rolls have a work roll diameter and the intermediate rolls have an intermediate roll diameter, and wherein adjusting the contact pressure parameter comprises adjusting at least one of the work roll diameter and the intermediate roll diameter.

7. The method of claim 5, wherein the work stand further comprises a set of upper bearings along the upper intermediate roll, each upper bearing applying a bearing load to the upper intermediate roll such that the upper intermediate roll causes the upper work roll to apply the first work roll pressure on the substrate.

8. The method of claim 7, wherein adjusting the contact pressure parameter comprises at least one of adjusting a spacing between adjacent upper bearings, adjusting a bearing dimension of at least one upper bearing of the set of upper bearings, reducing a crown or chamfer height of each one of the upper bearings, increasing the bearing load applied by all of the upper bearings on the upper intermediate roll, or adjusting the bearing loads applied by the upper bearings on the upper intermediate roll to adjust a distribution of the bearing loads.

9. The method of claim 7, wherein each one of the upper bearings is individually adjustable relative to the upper intermediate roll, and wherein adjusting the contact pressure parameter comprises increasing the bearing load applied by at least one of the upper bearings on the upper intermediate roll.

10. The method of claim 7, wherein the set of upper bearings comprises an outermost upper bearing having an inner end and an outer end, and wherein adjusting the contact pressure parameter comprises laterally adjusting the outermost upper bearing relative to an edge of the substrate.

11. The method of claim 1, wherein a variation in thickness across the width of the substrate is less than 2% after the texture has been applied.

12. The method of claim 1, wherein the work stand is a first work stand, the upper work roll is a first upper work roll, the texture is a first texture, and the lower work roll is a first lower work roll, and wherein the method further comprises:

applying a second texture to a substrate with a second work stand of the coil-to-coil process, wherein the second work stand comprises a second upper work roll and a second lower work roll vertically aligned with the second upper work roll, wherein at least one of the second upper work roll and the second lower work roll comprises the second texture, and wherein applying the second texture comprises:

applying, by the second upper work roll, a third work roll pressure on the upper surface of the substrate; and applying, by the second lower work roll, a fourth work roll pressure on a lower surface of the substrate, wherein the thickness of the substrate remains substantially constant after the second texture has been applied.

13. The method of claim 1, wherein the thickness of the substrate decreases by no more than 1% after the texture has been applied.

14. A coil-to-coil processing system comprising:

a work stand comprising:

an upper work roll configured to apply a first work roll pressure on an upper surface of a substrate; and a lower work roll vertically aligned with the upper work roll and configured to apply a second work roll pressure on a lower surface of the substrate, wherein at least one of the upper work roll and the lower work roll comprises a plurality of discrete locations along a width of the upper work roll or the lower work roll, wherein each discrete location comprises a texture, and wherein at least one of the upper work roll and the lower work roll are configured to impart the texture on the substrate by applying the first work roll pressure or applying the second work roll pressure; and a sensor configured to measure an actual contact pressure distribution of at least one of the first work roll pressure and the second work roll pressure across a width of the substrate;

a processing device configured to receive data from the sensor about the actual contact pressure distribution, compare the actual contact pressure distribution with a desired contact pressure distribution, and identify an adjustable contact pressure parameter of the work stand based on a difference between the actual contact pressure distribution and the desired contact pressure distribution, and adjust the identified adjustable contact pressure parameter at each discrete location independently at each discrete location of the plurality of discrete locations such that the actual contact pressure distribution provides the desired contact pressure distribution across the width of the substrate and a thickness of the substrate remains substantially constant after the texture has been applied.

15. The coil-to-coil processing system of claim 14, wherein the work stand further comprises:

an upper intermediate roll supporting the upper work roll; and a set of upper bearings along the upper intermediate roll, each upper bearing configured to apply a bearing load to the upper intermediate roll such that the upper intermediate roll causes the upper work roll to apply the first work roll pressure on the substrate.

16. The coil-to-coil processing system of claim 15, wherein the contact pressure parameter comprises at least one of a spacing between adjacent upper bearings, a bearing dimension of at least one upper bearing of the set of upper bearings, a bearing diameter and a bearing width, or a crown or chamfer height of each one of the upper bearings or the lower bearings to be less than about 50 μm.

17. The coil-to-coil processing system of claim 15, wherein each one of the upper bearings is individually adjustable relative to the upper intermediate roll, and wherein the contact pressure parameter comprises the bearing load applied by at least one of the upper bearings on the upper intermediate roll.

18. The coil-to-coil processing system of claim 15, wherein the set of upper bearings comprises an outermost upper bearing having an inner end and an outer end, and wherein the contact pressure parameter comprises a position of the outermost upper bearing relative to an edge of the substrate.

19. The coil-to-coil processing system of claim 14, wherein the upper work roll is vertically adjustable and wherein the lower work roll is vertically fixed such that only the upper work roll is actuatable.

20. The coil-to-coil processing system of claim 14, wherein a variation in thickness across the width of the substrate is less than 2% after the texture is applied, and wherein the first work roll pressure and the second work roll pressure are less than a yield strength of the substrate.

* * * * *